US007746046B2

(12) United States Patent
Chen

(10) Patent No.: US 7,746,046 B2
(45) **Date of Patent: *Jun. 29, 2010**

(54) POWER MANAGEMENT UNIT FOR USE IN PORTABLE APPLICATIONS

(75) Inventor: Chun-Ying Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/790,036

(22) Filed: Apr. 23, 2007

(65) Prior Publication Data

US 2007/0194771 A1 Aug. 23, 2007

Related U.S. Application Data

(63) Continuation of application No. 11/037,186, filed on Jan. 19, 2005, now Pat. No. 7,224,156, which is a continuation of application No. 10/643,956, filed on Aug. 20, 2003, now Pat. No. 6,879,142.

(51) Int. Cl.
*G05F 1/618* (2006.01)

(52) U.S. Cl. ..... 323/270; 323/269; 323/266

(58) Field of Classification Search ..... 323/269, 323/270, 266, 280, 224, 226, 268, 273, 267; 307/23, 29, 80, 85, 86
See application file for complete search history.

(56) References Cited

U.S. PATENT DOCUMENTS 4,290,007 A * 9/1981 Fisher et al. ..... 323/270
5,036,269 A * 7/1991 Murari et al. ..... 323/266
5,410,241 A 4/1995 Cecil
5,528,127 A * 6/1996 Streit ..... 323/269
5,631,598 A 5/1997 Miranda et al.
5,637,992 A * 6/1997 Edwards ..... 323/315
5,867,015 A * 2/1999 Corsi et al. ..... 323/316
5,986,910 A 11/1999 Nakatsuka
6,031,362 A * 2/2000 Bradley ..... 323/269
6,049,227 A 4/2000 Goetting et al.
6,049,243 A 4/2000 Mihara et al.
6,184,716 B1 2/2001 Depetro et al.
6,246,221 B1 6/2001 Xi
6,333,623 B1 * 12/2001 Heisley et al. ..... 323/280
6,370,071 B1 4/2002 Lall et al.
6,522,111 B2 2/2003 Zadeh et al.
6,535,019 B2 3/2003 De Santis
6,566,935 B1 * 5/2003 Renous ..... 327/408
6,600,299 B2 7/2003 Xi
6,653,789 B2 * 11/2003 Roller et al. ..... 315/80
6,674,270 B2 1/2004 Sakamoto
6,677,735 B2 * 1/2004 Xi ..... 323/273
6,765,374 B1 7/2004 Yang et al.

(Continued)

*Primary Examiner*—Harry Behm
(74) *Attorney, Agent, or Firm*—Sterne, Kessler, Goldstein & Fox P.L.L.C.

(57) ABSTRACT

A voltage regulator includes a first stage capable of receiving a reference voltage and capable of having a first current flowing through the first stage. A second stage is capable of having a second current flowing through the second stage. A third stage is capable of outputting an output voltage and capable of having a third current flowing through the second stage. The first, second and third currents are proportional to each other throughout a range of operation of the voltage regulator between substantially zero output current and maximum output current. The first stage drives the second stage as a low input impedance load.

27 Claims, 19 Drawing Sheets

U.S. PATENT DOCUMENTS 6,865,382 B2 3/2005 Behzad
6,879,142 B2 4/2005 Chen
6,894,472 B2 5/2005 Chen
7,030,595 B2 4/2006 Shinichi
7,057,310 B2 * 6/2006 Liu et al. ..... 307/126
7,126,319 B2 10/2006 Chen
7,129,600 B2 * 10/2006 Wu et al. ..... 307/80
7,161,339 B2 1/2007 Chen et al.
7,224,156 B2 5/2007 Chen
2005/1034252 6/2005 Chen

* cited by examiner

| spec | TI | Maxim | Philips | BRCM | Unit |
|---|---|---|---|---|---|
| Part # | TPS72116 | MAX8875EUK15 | PCF50604 | BCM2123 | |
| Output Current | 150 | 150 | | 150 | mA |
| Output Voltage | 1.22-2.5 | 1.5 | - | 1.2-3.2 | V |
| VO Accuracy | +/- 3 | +/- 3 | +/-3.5 | +/-3.5 | % |
| Input Voltage | 1.8-5.5 | 2.5-6.5 | | 3.3 | |
| Dropout voltage@150mA | 150 | 165 | | 14 | mV |
| VO Line Step Response | | 40 | 3 | 0.9 | mV |
| VO Load Regulation | 0.014 | 0.01 | 0.01 | 0.002 | %/mA |
| VO Load Step Response | 6.3 | 0.9 | 4 | 0.9 | % |
| Line Regulation | 0.72 | 7.4 | 1 | 0.17 | mV/V |
| Ground pin current@OFF | <1 | <1 | <1 | <1 | uA |
| Ground pin current@no load | 85 | 85 | 30 | 7 or 21 | uA |
| Ground pin Current@150mA | 570 | 100 | 3000 | 1500 | uA |
| Activation Time | 20 | 20 | 130 | 12 | us |
| Output Noise Voltage(200-100K) | 90 | 170 | | 84 | uV |
| PSRR@100Hz | 48 | 60 | 60 | 58 | dB |
| External Capacitor | 1 | 10 | 4.7 | 3 | uF |

FIG. 18

POWER MANAGEMENT UNIT FOR USE IN PORTABLE APPLICATIONS

CROSS-REFERENCE TO RELATED APPLICATIONS

This application is a continuation of application Ser. No. 11/037,186, filed Jan. 19, 2005 now U.S. Pat. No. 7,224,156, which is a continuation of application Ser. No. 10/643,956, filed Aug. 20, 2003 now U.S. Pat. No. 6,879,142.

BACKGROUND OF THE INVENTION

1. Field of the Invention

The present invention relates to power management units for portable applications, and more particularly to high efficiency, low loss power management units.

2. Description of the Related Art

Power management in portable electronic systems, such as cellular phone, portable PDAs, laptops, etc. is an important issue, as consumers increasingly demand longer times between recharging. For example, a cellular phones typically has three power sources: a rechargeable main battery, a small coin-sized backup battery, and a line charger that can be plugged into a wall outlet or a car outlet. Typical main battery voltage is between about 3.3 volts and 4.6 volts. Typical charger voltage is 5-20V.

Power management units (PMUs) are often manufactured using non-standard (i.e., high voltage) CMOS processes or using bi-polar. In the case of CMOS PMUs, power efficiency and the breakdown voltage of the CMOS devices are important parameters to consider. For 0.35 micron manufacturing technology, the typical breakdown voltage of the CMOS devices is approximately 3.3 volts. As feature size decreases, the breakdown voltage of the CMOS device also decreases. However, the battery voltage, or some other operational power source (e.g., the line charger), normally has a higher voltage than the breakdown voltage. Therefore, the battery voltage needs to be regulated down to 3.3 volts so as to be suitable for use by the power management unit and the rest of the circuitry.

Conventional alternatives for managing the breakdown voltage issue include the use of bipolar technology, or the use of special (high-voltage) CMOS devices. However, the use of bipolar technology presents difficulties with integrating the bipolar elements with other CMOS circuit elements. Thus, it is desirable to use low voltage CMOS devices to implement high voltage power management.

If only CMOS devices are used, the breakdown problem could be overcome by the use of several CMOS devices. For example, a number of CMOS devices could be cascaded in order to share the voltage drop to avoid breakdown in each device. The drawback of such an approach is an increase in power dissipation because the whole branch cannot be powered down. In particular, if every circuit has all the functionality of breakdown protection, the power dissipation is significantly increased. This is particularly a problem in the OFF mode, where the cascoded CMOS devices dissipate power even while the rest of the circuitry is "asleep." In other words, there is a constant current flow to the CMOS devices whose sole purpose is breakdown prevention. This decreases the life of the main battery, which is an important concern in portable applications, such as cellular phones.

Accordingly, what is needed is a power management unit that provides a high efficiency both during operation and when the circuitry is off, and which is compatible with existing CMOS processes.

SUMMARY OF THE INVENTION

The present invention is directed to a power management unit for use in portable applications that substantially obviates one or more of the problems and disadvantages of the related art.

There is provided a voltage regulator circuit including a high voltage regulator capable of receiving an external high voltage supply and capable of outputting an intermediate supply voltage. A plurality of parallel low voltage regulators are capable of receiving the intermediate supply voltage and capable of outputting a regulated output voltage. The intermediate supply voltage is no higher than a breakdown voltage of the low voltage regulators.

In another aspect there is provided a voltage regulator circuit including a single high voltage regulator, and a plurality of parallel low voltage regulators capable of receiving an intermediate voltage from the high-voltage regulator, and capable of outputting a regulated output voltage. The intermediate voltage is no higher than a breakdown voltage of the low voltage regulators.

In another aspect there is provided a voltage regulator including a first stage capable of receiving a reference voltage and capable of having a first current flowing through the first stage. A second stage is capable of having a second current flowing through the second stage. A third stage is capable of outputting an output voltage and capable of having a third current flowing through the second stage. The first, second and third currents are proportional to each other throughout a range of operation of the voltage regulator between substantially zero output current and maximum output current. The first stage drives the second stage as a low input impedance load.

In another aspect there is provided a power supply multiplexing circuit including a first supply voltage input. A first pair of cascoded PMOS transistors are in series with the first supply voltage input. A first native NMOS transistor is in series with the first pair of cascoded PMOS transistors. Also, a second supply voltage input and a second pair of cascoded PMOS transistors are in series with the second supply voltage input; and a second native NMOS transistor in series with the second pair of cascoded PMOS transistors. The gates of the first and second native NMOS transistors are driven by two control signals out of phase with each other, and sources of the first and second native NMOS transistors are connected together to output an output voltage.

Additional features and advantages of the invention will be set forth in the description that follows. Yet further features and advantages will be apparent to a person skilled in the art based on the description set forth herein or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS/FIGS.

The accompanying drawings, which are included to provide a further understanding of the exemplary embodiments of the invention and are incorporated in and constitute a part of this specification, illustrate embodiments of the invention and together with the description serve to explain the principles of the invention. In the drawings.

Figure 2:
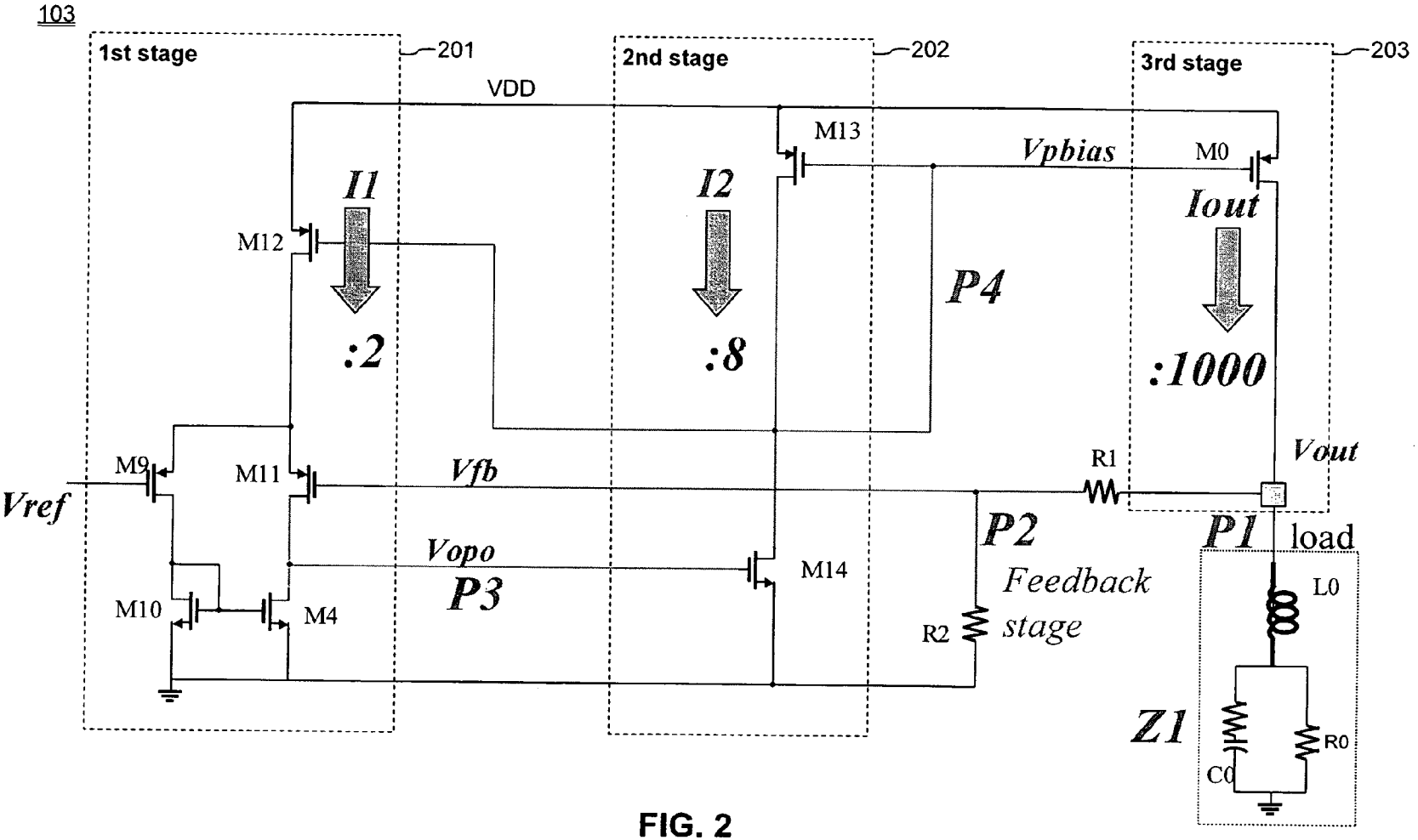
FIG. 2 represents a starting point for designing the low voltage regulator of FIG. 1.
Figure 4:
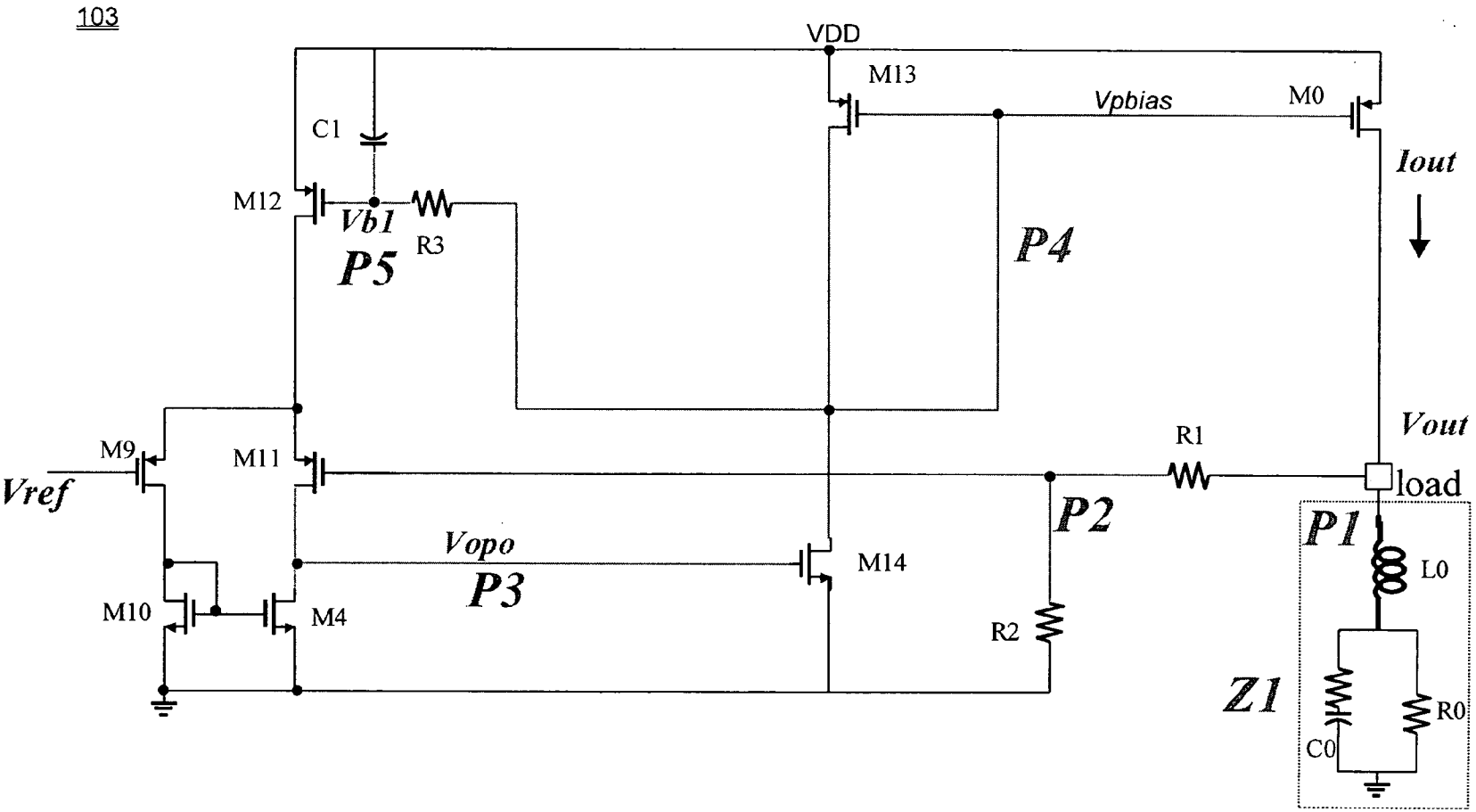

FIG. 4. shows the circuit of FIG. 2 with a pole P5 added.

Figure 5:
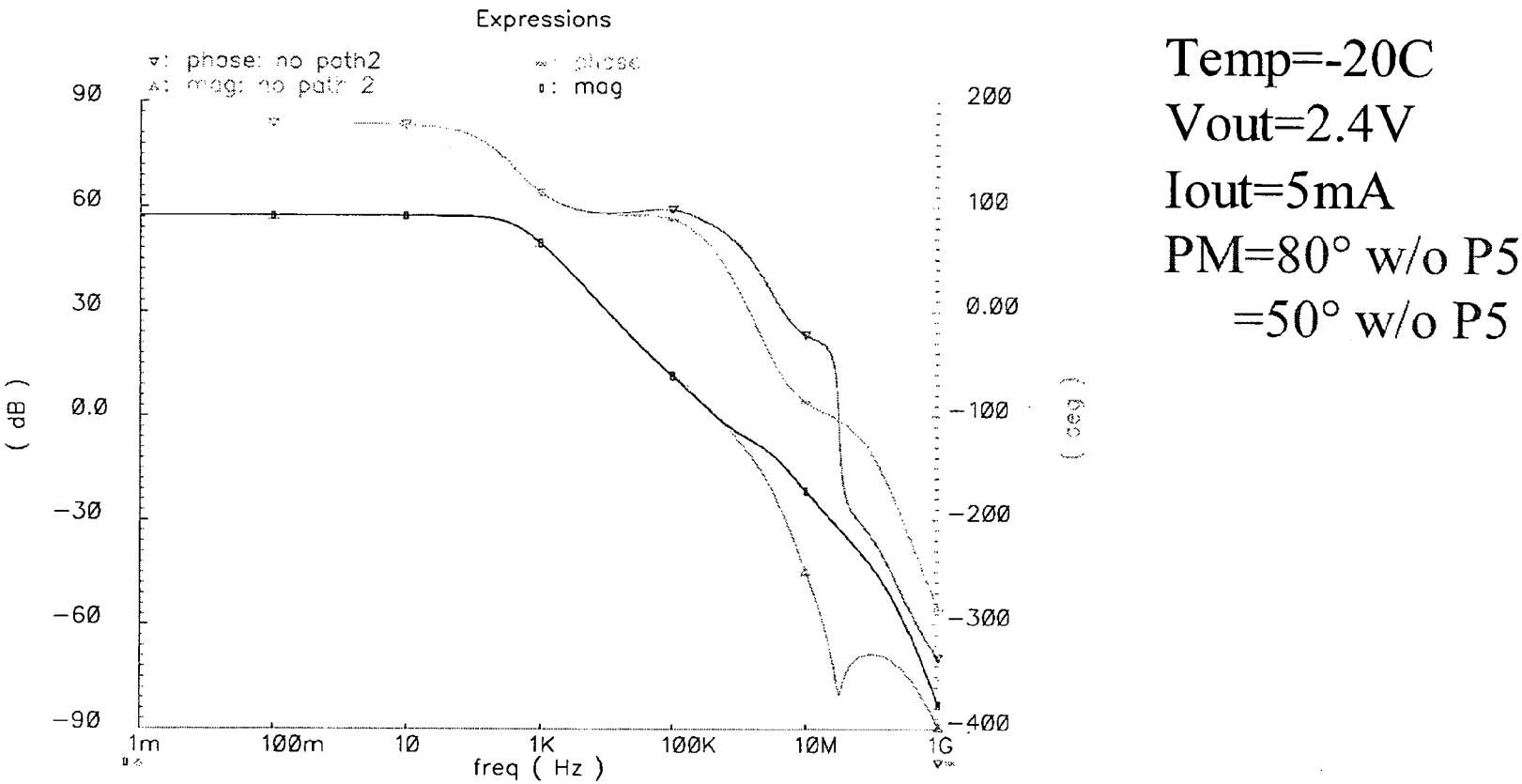

FIG. 5 illustrates the effect the addition of the pole P5 on the phase margin of the circuit of FIG. 2.

Figure 6:
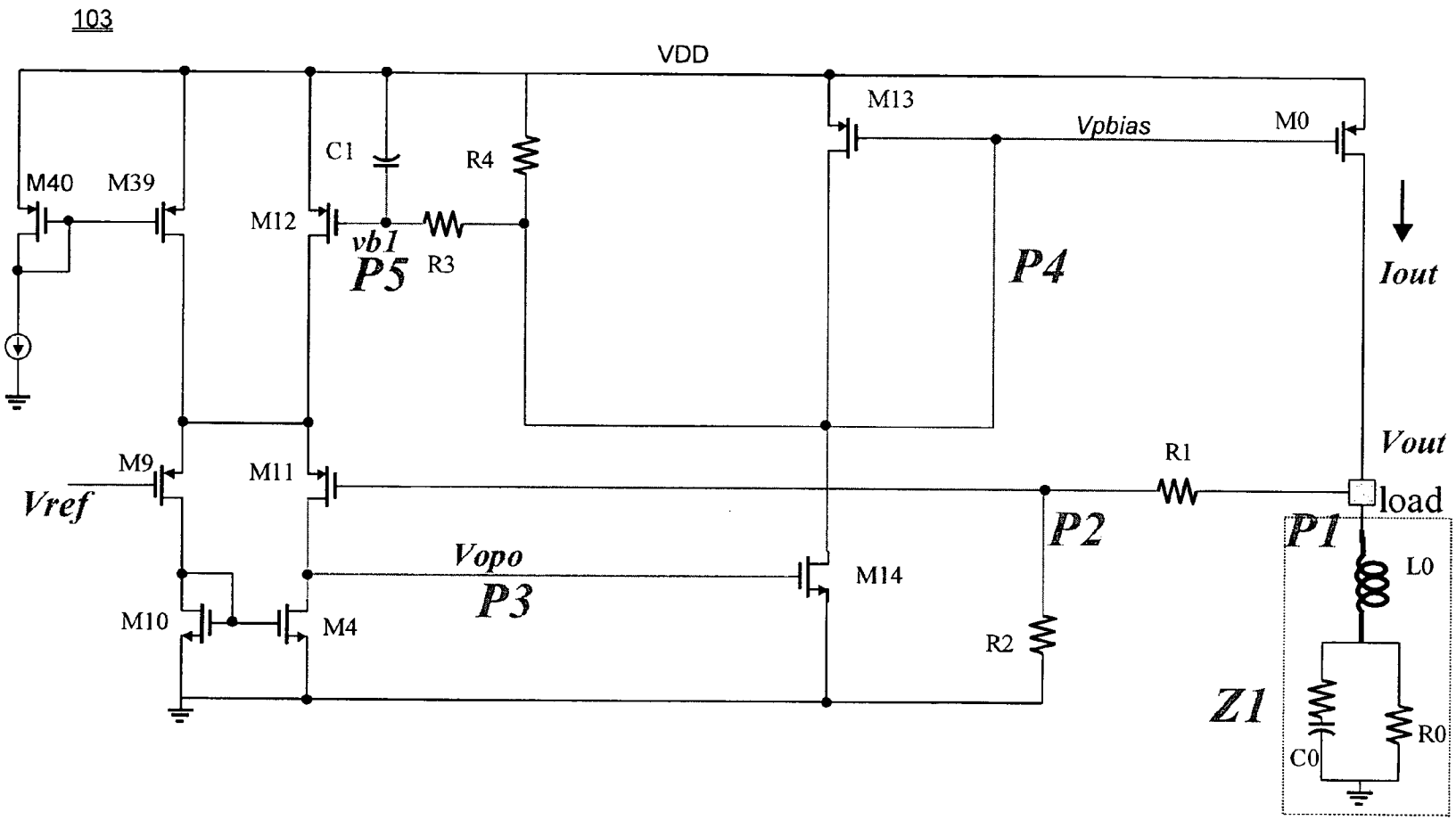

FIG. 6 shows the circuit of FIG. 5 with "trickle current" circuitry added.

Figure 7:
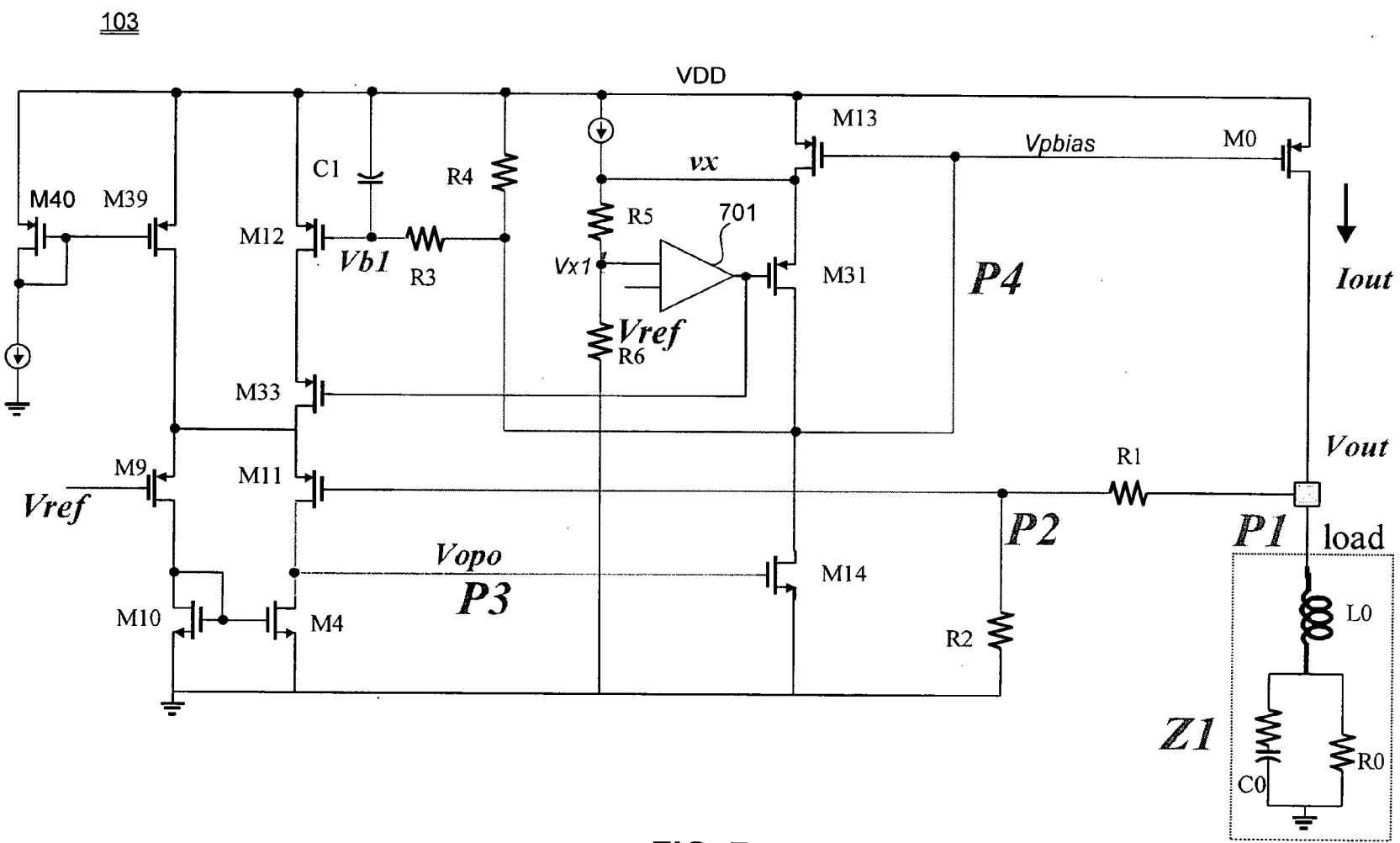

FIG. 7 illustrates the addition of a switch for low current operation.

Figure 8:
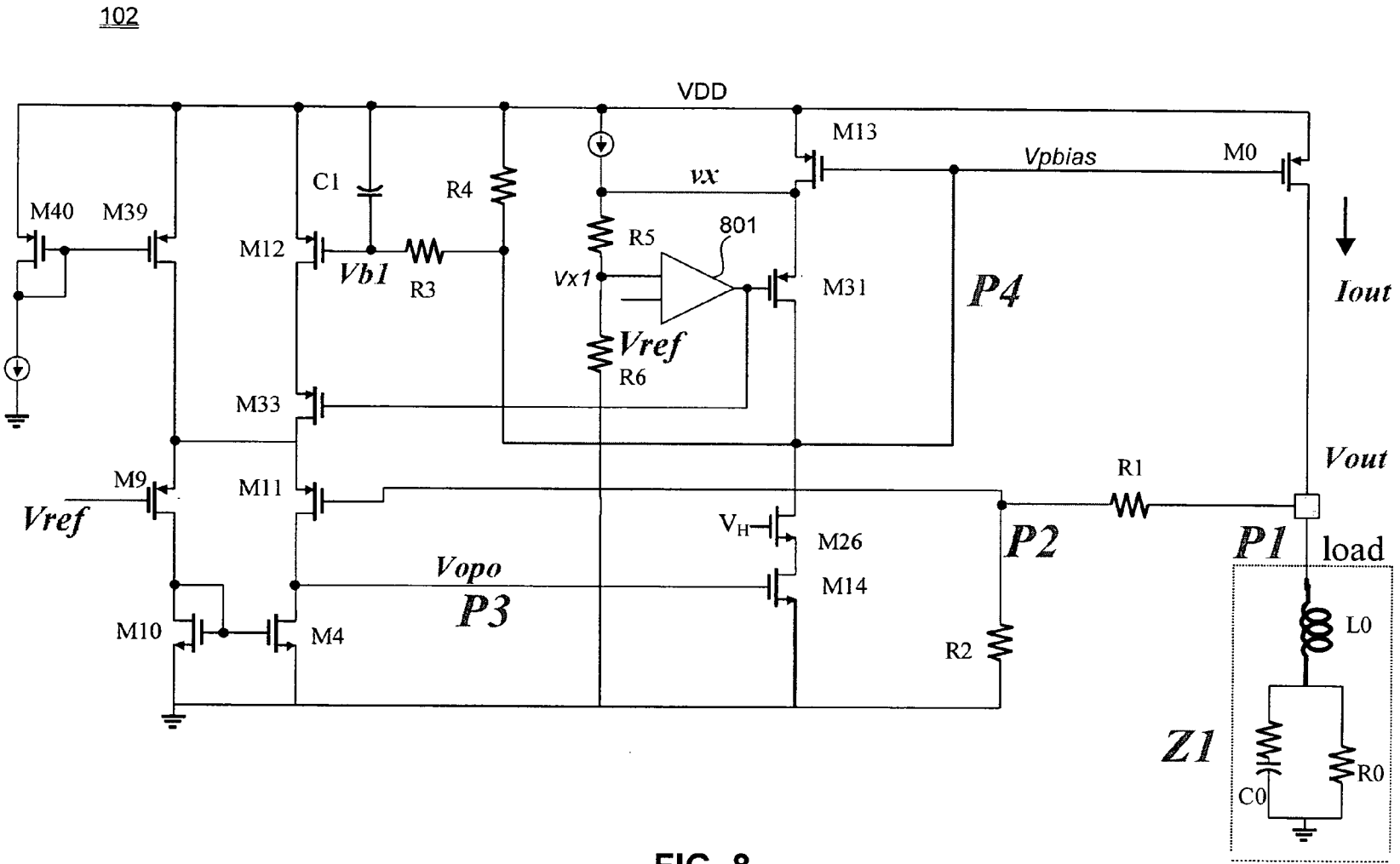

FIG. 8 illustrates conversion of the low voltage regulator of FIG. 7 into a high voltage low dropout regulator.

Figure 9:
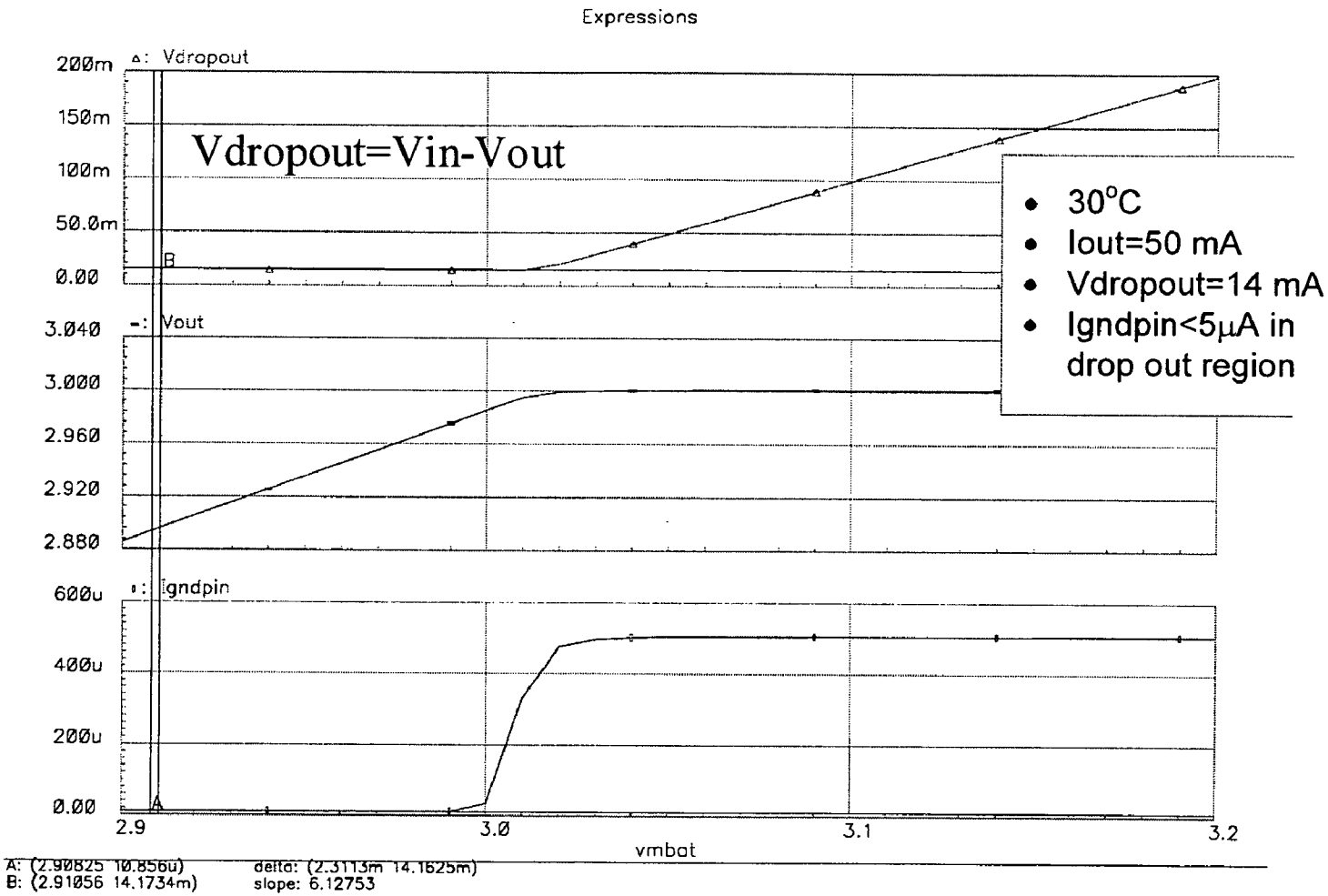

FIG. 9 shows the drop-out voltage performance of the voltage regulators of FIGS. 7 and 8.

Figure 10:
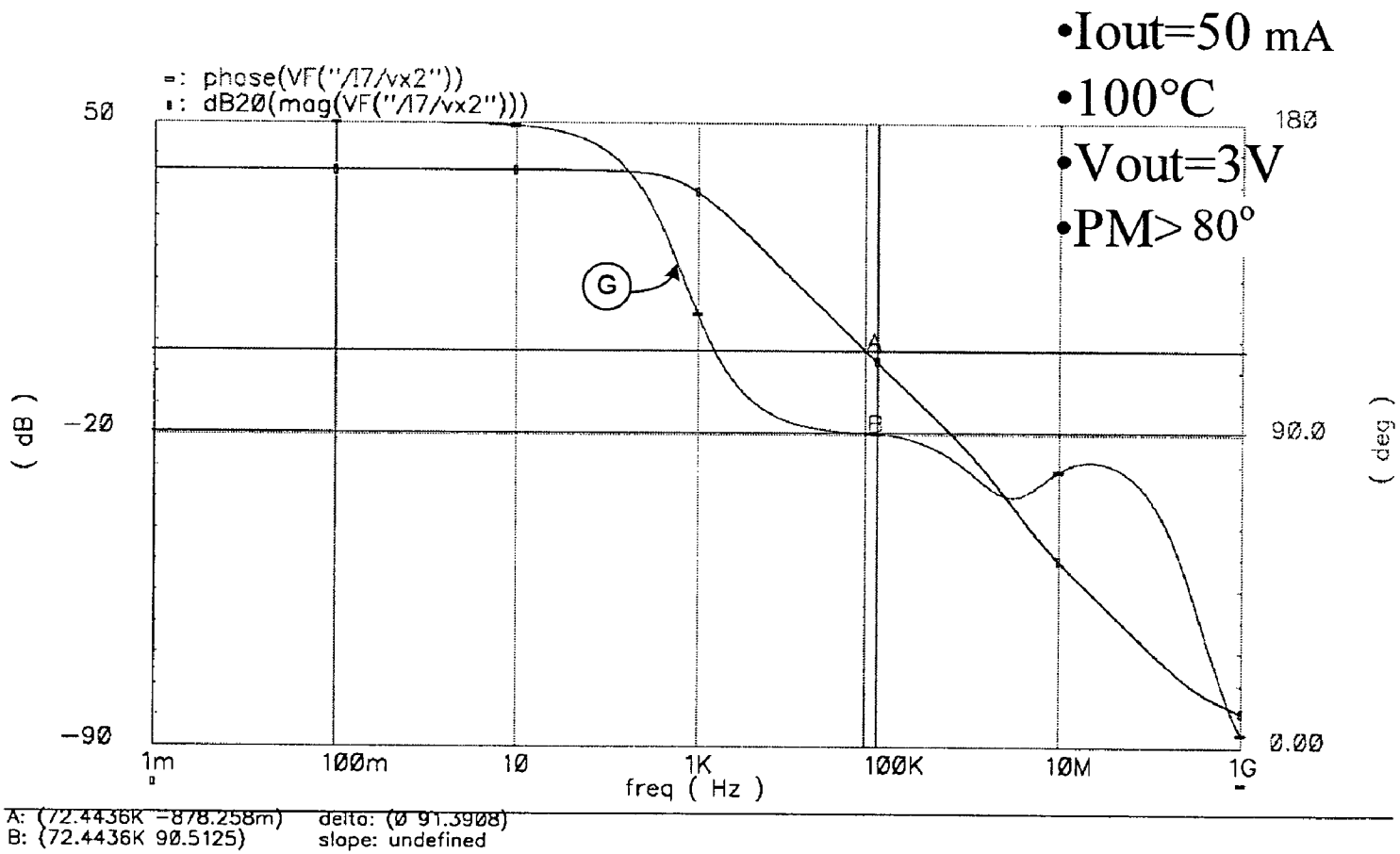

FIG. 10 shows the phase margin and open loop gain of the circuit of FIG. 7 as a function of frequency.

Figure 11:
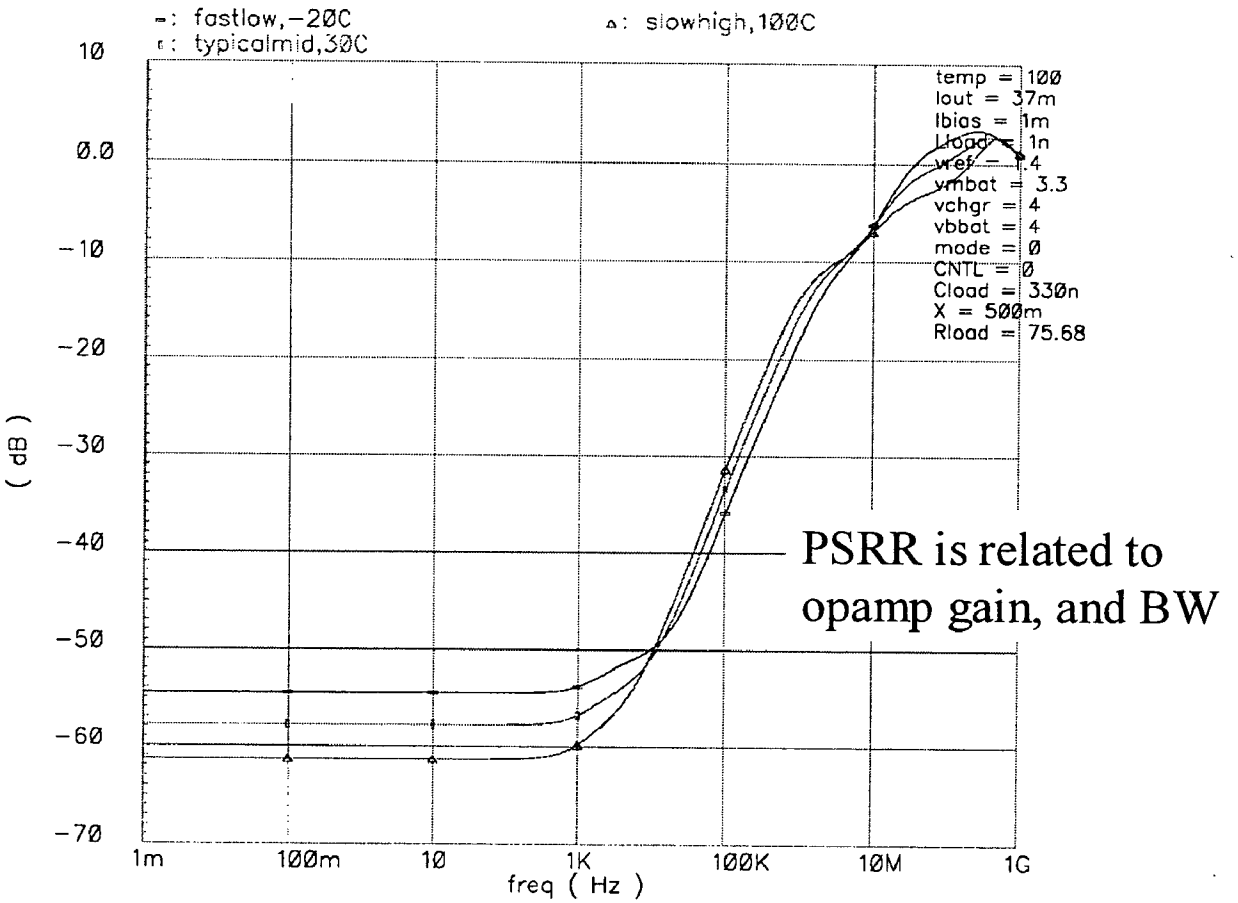

FIG. 11 shows performance relating to a power supply rejection ratio (PSRR).

Figure 12:
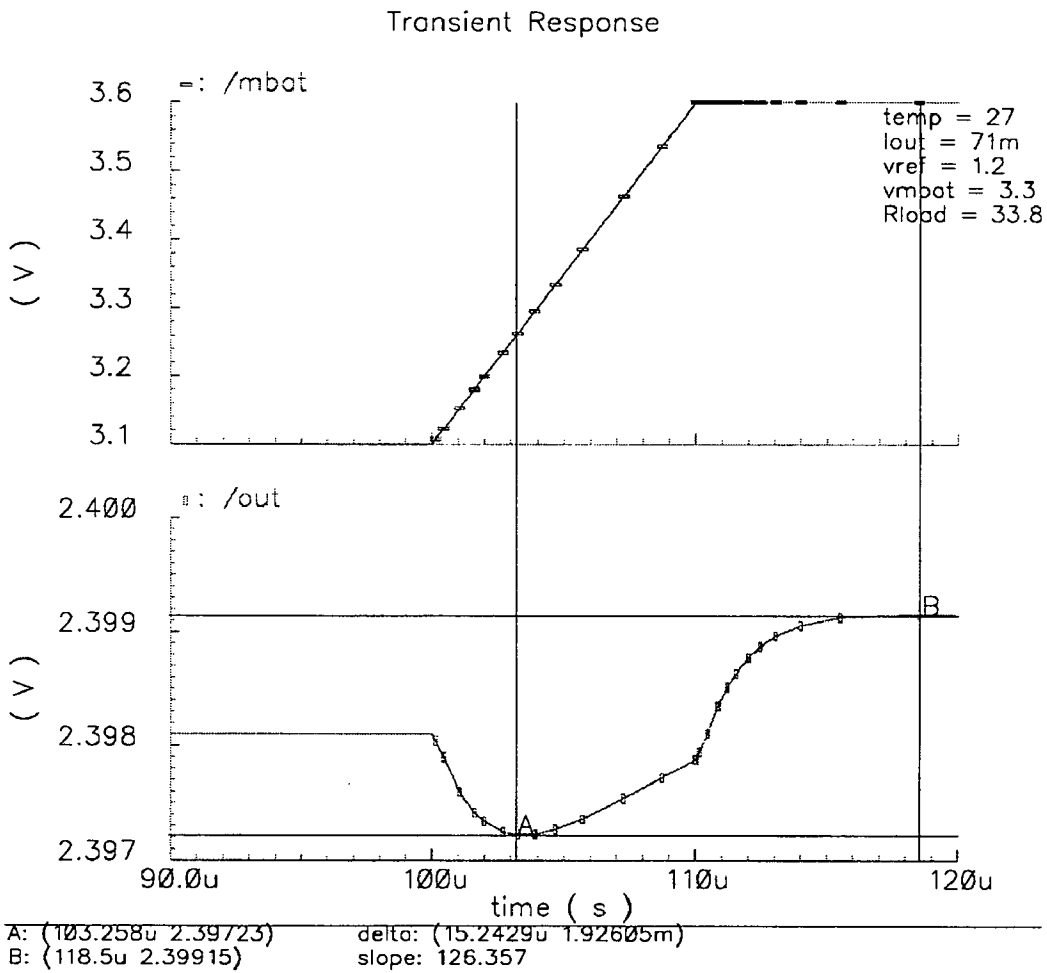

FIG. 12 shows the line step response of the low voltage regulator of FIG. 7.

Figure 13:
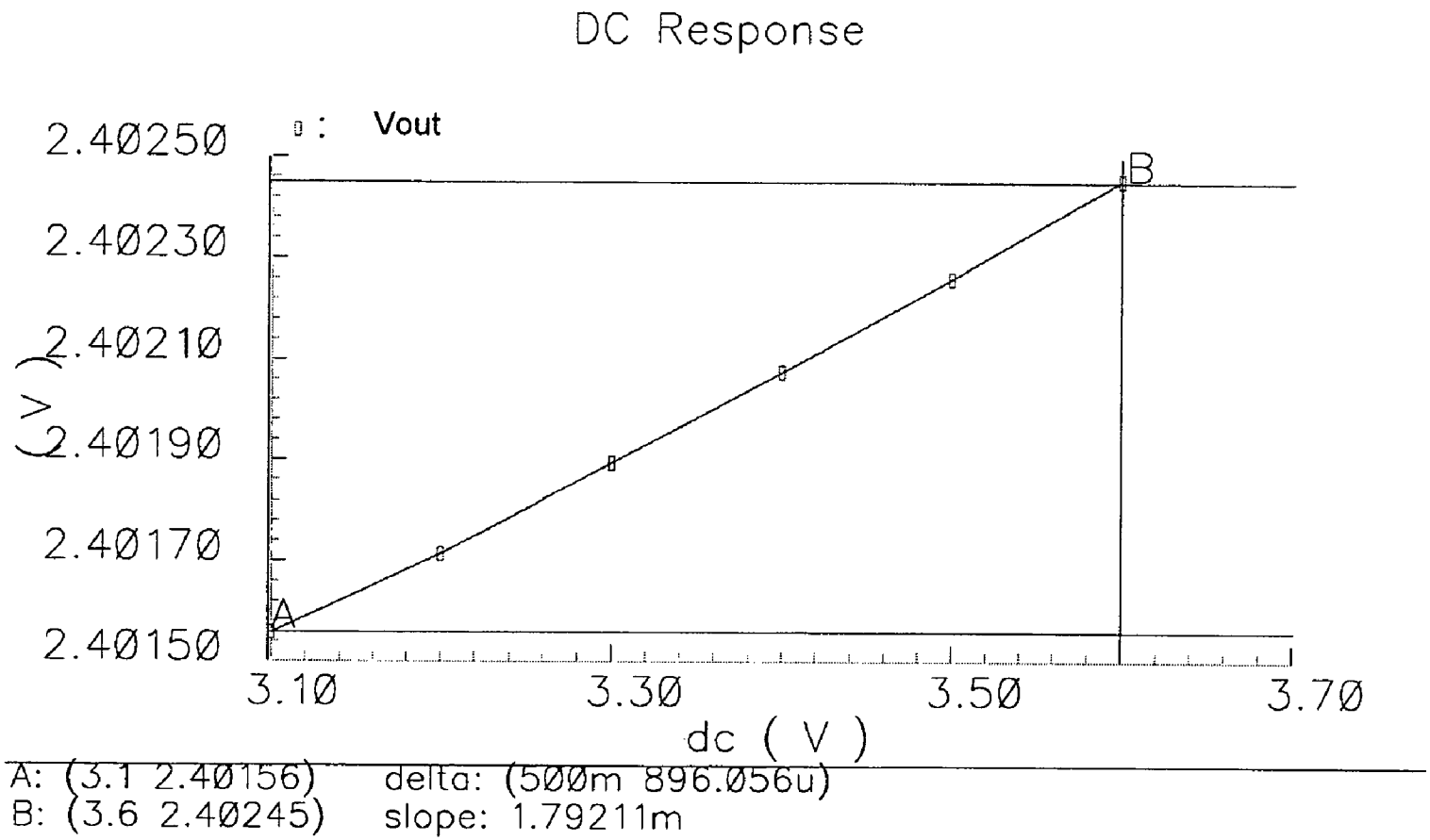

FIG. 13 illustrates the change in the output voltage as a function of change in the supply voltage.

Figure 14:
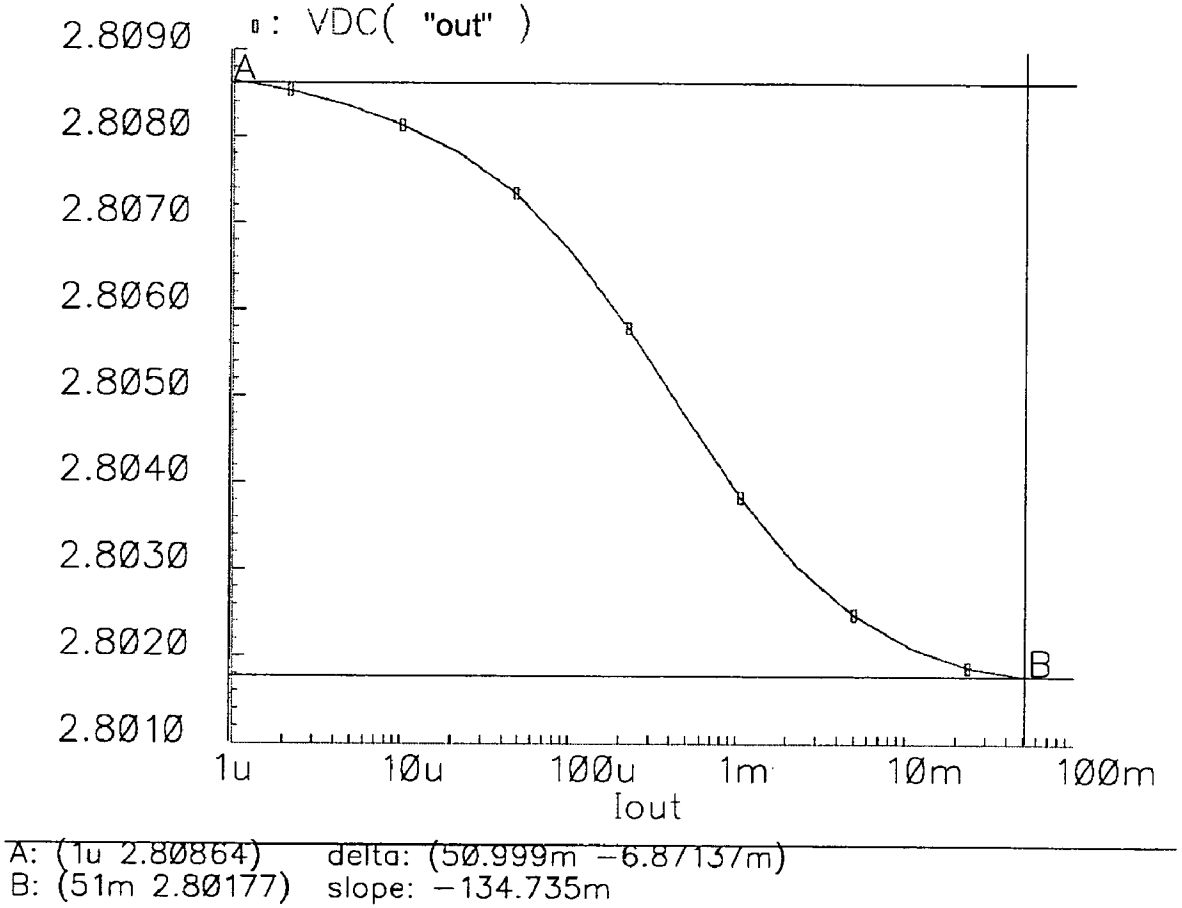

FIG. 14 illustrates the output voltage $V_{out}$ as a function of the output current $I_{out}$. This figure shows that for a relatively large change in $I_{out}$, the output voltage $V_{out}$ remains relatively steady.

Figure 15:
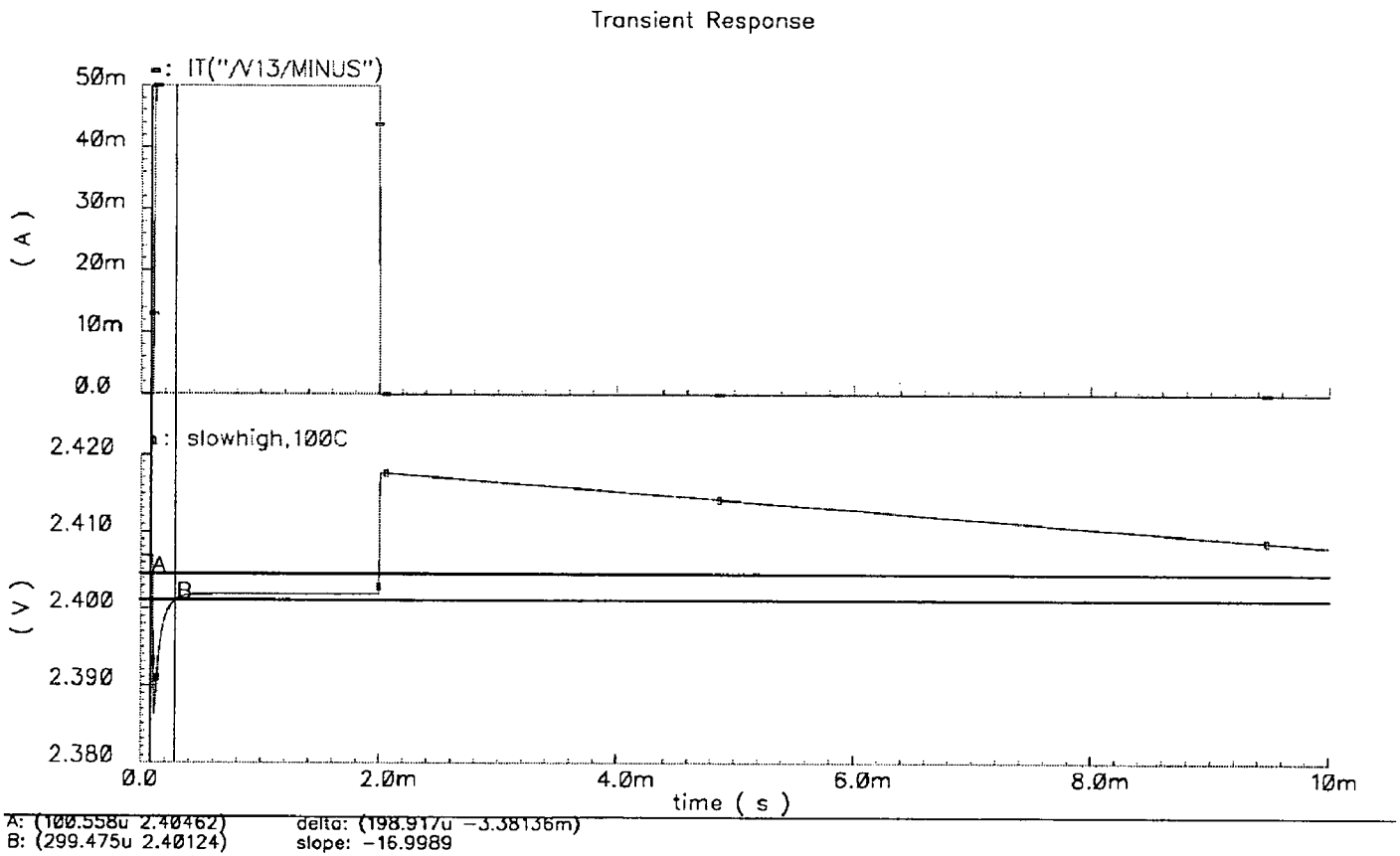

FIG. 15 illustrates the turn-on response of the low voltage regulator of FIG. 7.

Figure 16:
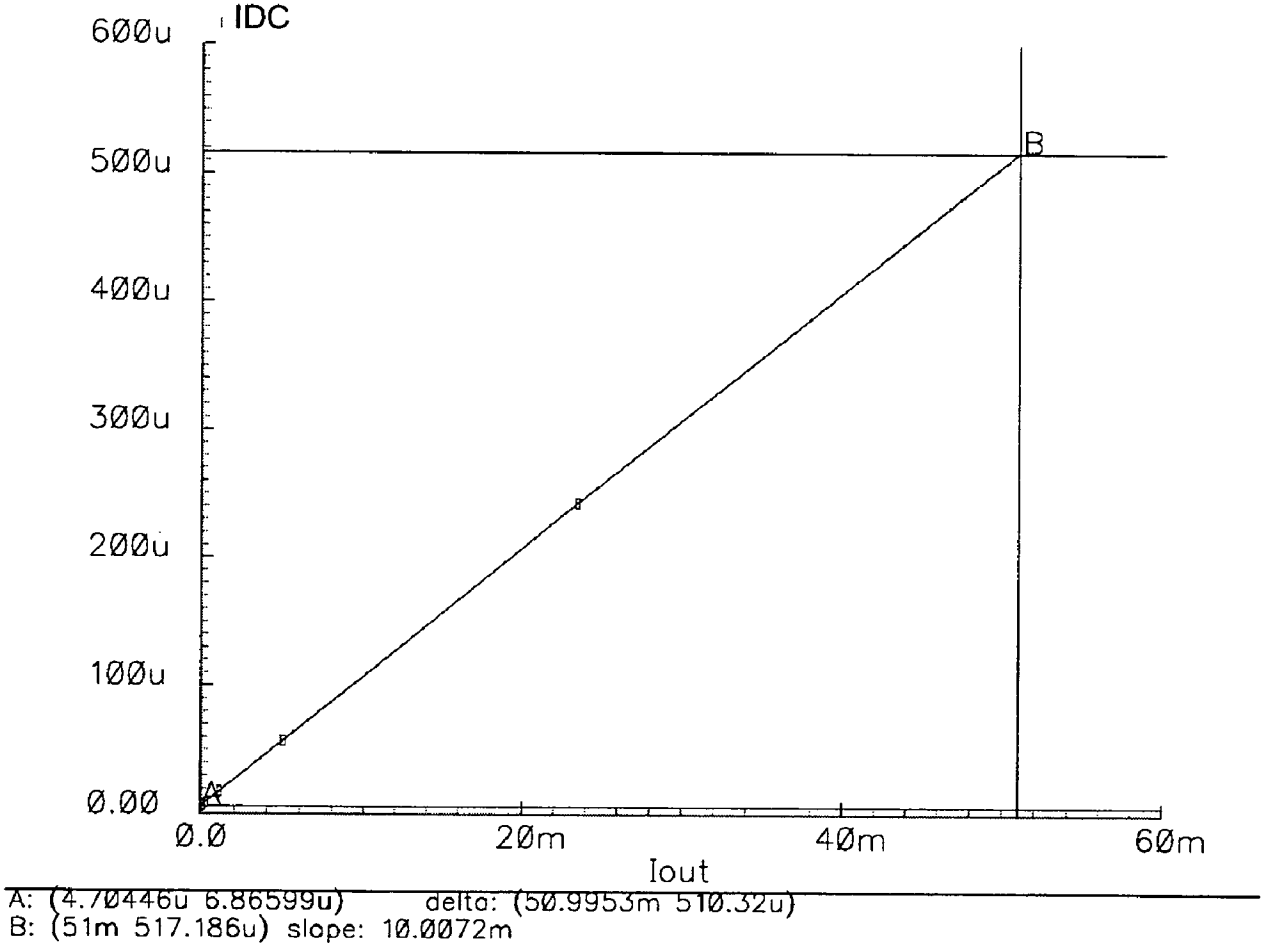

FIG. 16 is an illustration of the total power consumption as a function of current of the low voltage regulator of FIG. 7.

Figure 17:
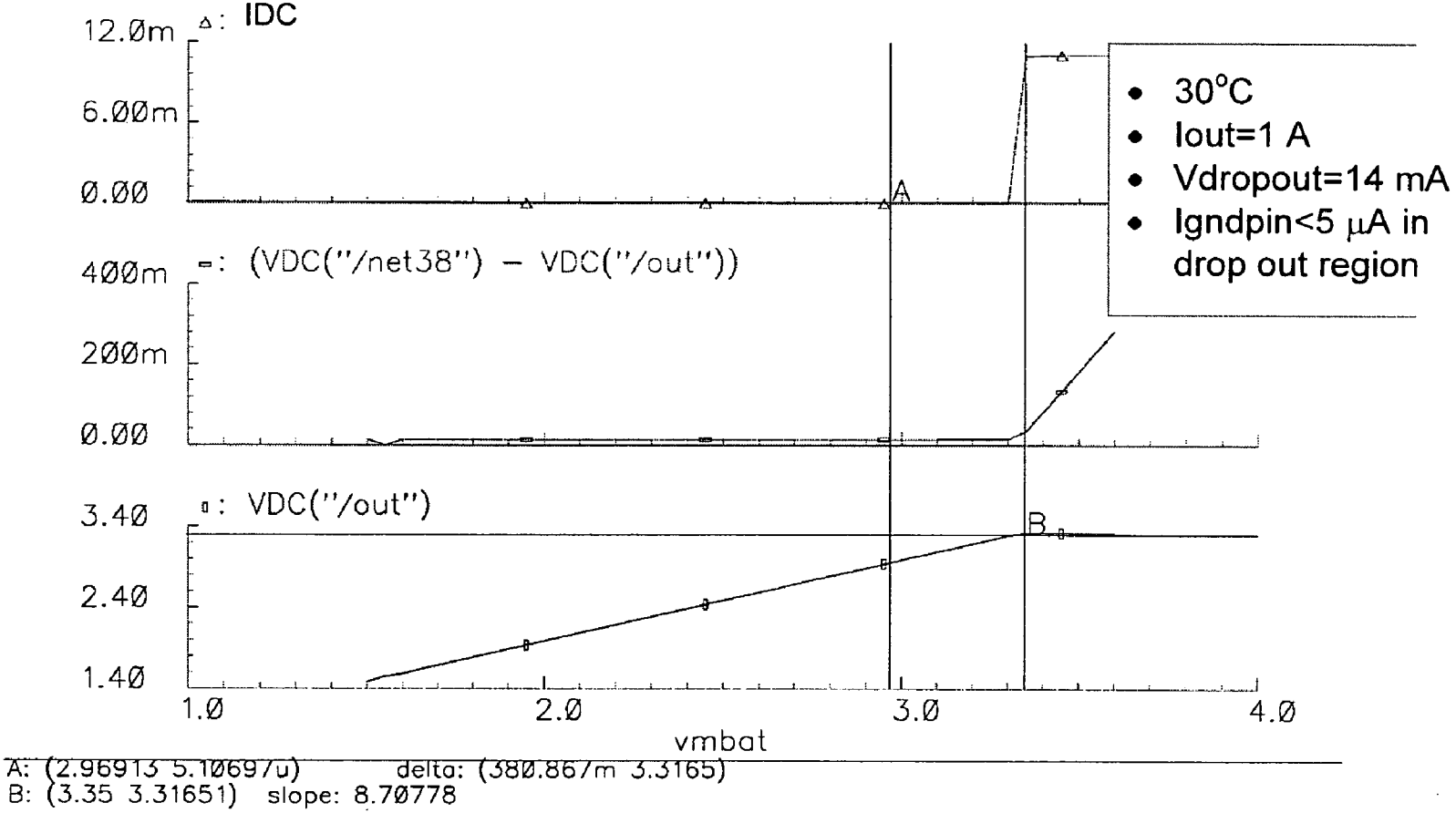

FIG. 17 illustrates simulated performance of the high voltage regulator of FIG. 8 with regard to the drop-out voltage.

FIG. 18 compares conventional voltage regulators and the voltage regulator of the present invention.

Figure 19:
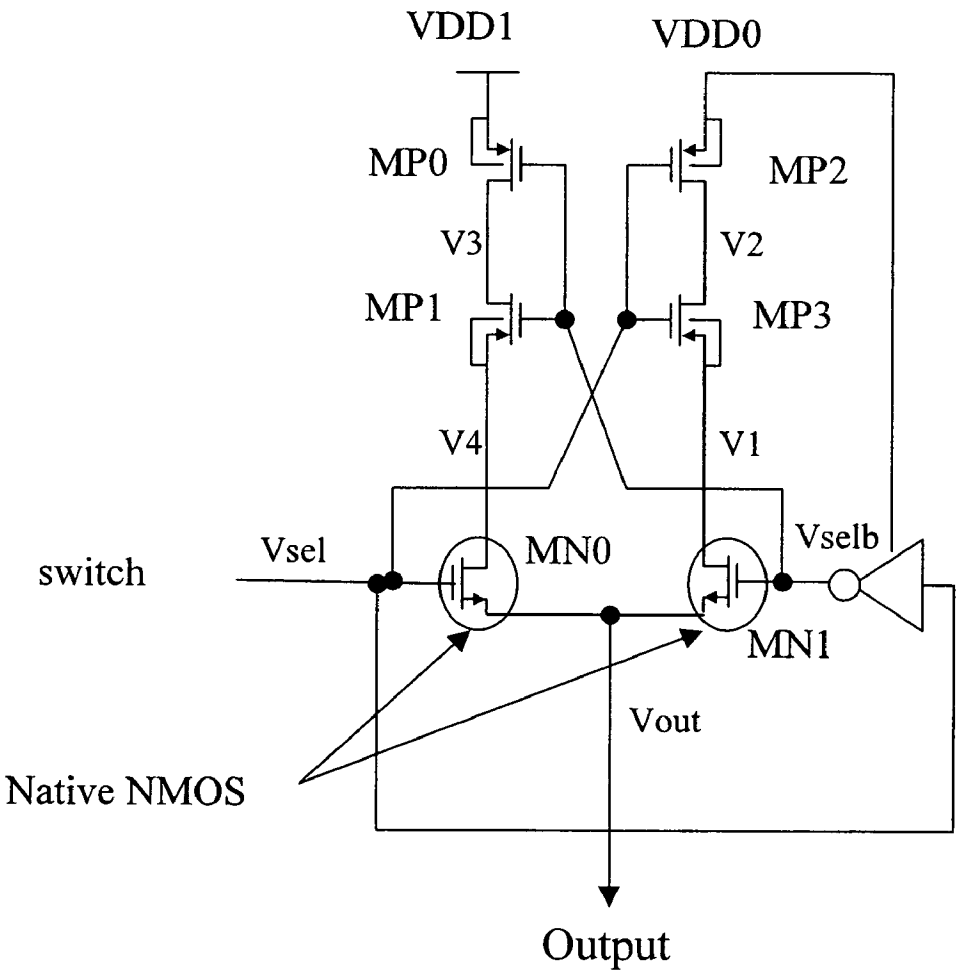

FIG. 19 shows a high-efficiency circuit is used as a multiplexer to select different power sources.

DETAILED DESCRIPTION OF THE INVENTION

Reference will now be made in detail to the embodiments of the present invention, examples of which are illustrated in the accompanying drawings.

Figure 1:
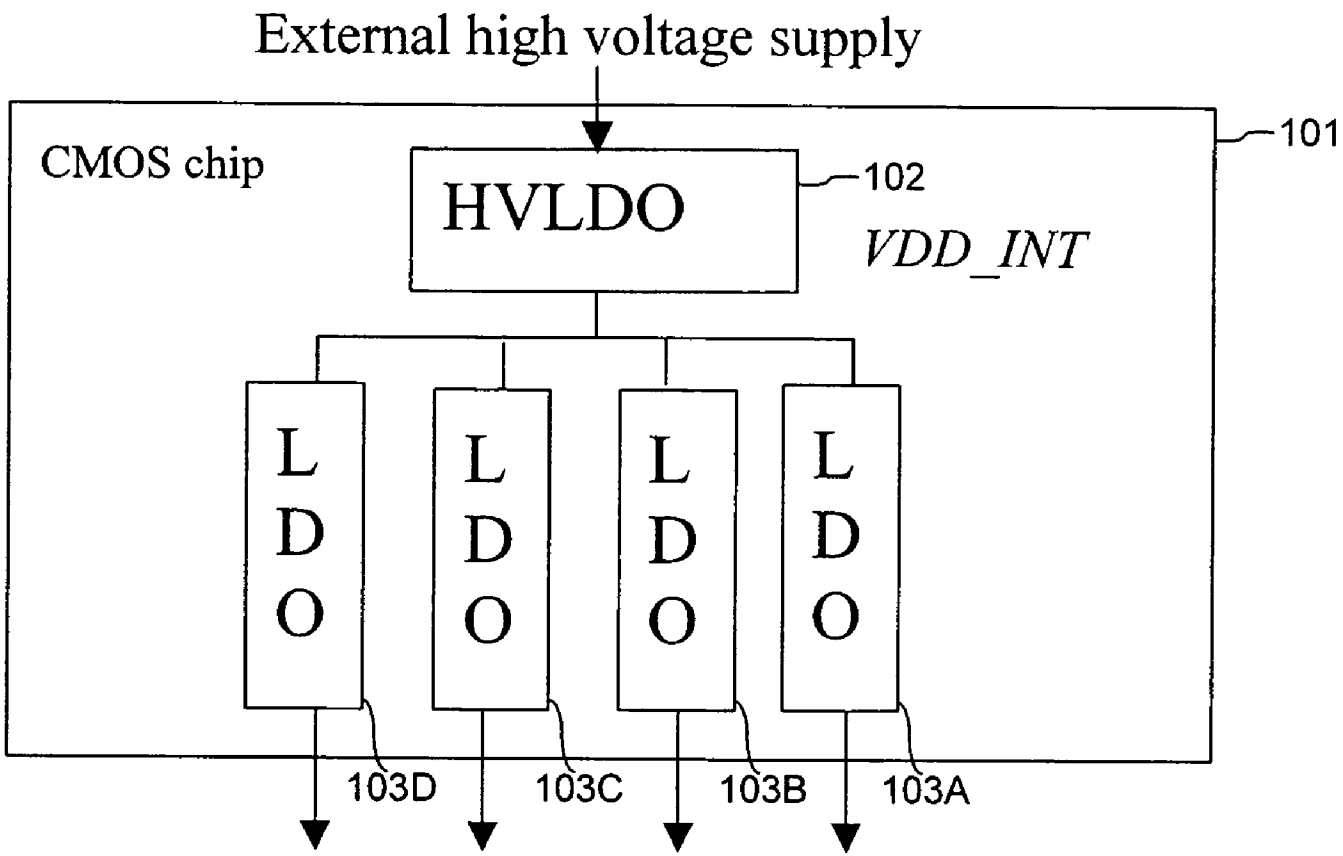
FIG. 1 illustrates a voltage regulator arrangement of the present invention.

FIG. 1 illustrates a voltage regulator arrangement of the present invention. As shown in FIG. 1, a CMOS voltage regulator chip 101 has an external high voltage supply as an input. The external high voltage supply may be a main battery, typically with a maximum output voltage of about 3.3-4.6 volts, or a line charger input (5-20V). The output voltage range of 3.3-4.6 volts is typical for lithium ion type batteries. The regulator chip 101 includes one high voltage low dropout (HVLDO) regulator 102 (hereafter, sometimes referred to as "high voltage regulator"), outputting a voltage VDD_INT, which is at or below the breakdown voltage of the downstream CMOS devices.

In series with the high voltage low dropout regulator 102 are a plurality of low voltage low dropout regulators (LVLDO's) 103A-103D (hereafter, sometimes referred to as "low voltage regulators"), arranged in parallel, such that the low voltage regulators 103 are protected from breakdown voltage issues. In this manner, because only a single high voltage regulator 102 is used, the amount of power dissipated due to breakdown protection is minimized. Thus, only one circuit (i.e. high voltage regulator 102) deals with the breakdown issues. The low voltage regulators 103 can be powered down completely when the cell phone is turned off. Also, the design issues are considerably simplified, since only a single high voltage regulator 102 is necessary. The high voltage regulator 102 outputs an intermediate voltage of VDD_INT. For example, VDD_INT can be 3.3V, or even lower.

Thus, the voltage drop across the high voltage regulator 102 is up to approximately 1.5 volts, depending on the charge in the main battery. The advantage of the architecture shown in FIG. 1 is that the low voltage regulators 103 can be turned off completely when not in use, without concern about the breakdown issues.

Thus, instead of using multiple high voltage regulators, the architecture in FIG. 1 uses a single high voltage regulator 102 cascoded with a plurality of low voltage regulators 103. One advantage of the present invention is that standard CMOS devices can be used, without resorting to either high-voltage CMOS devices or the use of bipolar transistors.

With reference to the low voltage regulator 103, operational amplifiers (opamps) are frequently used, however, in order to maintain stability, they frequently need to draw a lot of current. Thus, in order to improve the overall efficiency of the power management unit and extend the life of the main battery, it is necessary to reduce the amount of current drawn by opamp circuits in the low voltage regulator 103. This process, discussed in detail below, may be referred to as "adaptive biasing." Through the use of adaptive biasing, in the ideal case, the current drawn by the opamp would be proportional to the output current of the regulator. For example, the ratio could be 1%, i.e., the current consumed by the opamp is 1:100 compared to the output current of the low voltage regulator 103. Thus, if the low voltage regulator 103 supplies 1 milliamp of current, its opamp would consume about 10 microamps.

FIG. 2 represents a starting point for designing the low voltage regulator 103 of FIG. 1. As may be seen in FIG. 2, the load is modeled by an inductor L0, a resistor R0 and capacitor C0. The transistor M0 is usually referred to as a "pass transistor," i.e., it passes current from a supply voltage source, for example, VDD, to the load. A transistor M13 is a mirror transistor for M0, since the gates of both transistors M0 and M13 are driven by the same voltage, designated $V_{pbias}$ in FIG. 2. A resistor divider, composed of resistors R1 and R2, is used as a feedback stage. Transistors M9 and M11 are input transistors, and together form an amplifier 204. The feedback voltage $V_{fb}$ is compared to the input voltage $V_{ref}$. If the voltage $V_{fb}$ is not equal the voltage $V_{ref}$, the voltage on the gate of the pass transistor M0 is adjusted.

For example, if the voltage $V_{fb}$ is too low, the voltage on the gate of the transistor M0 is adjusted to make the output voltage $V_{out}$ increase. Thus, the circuit keeps the feedback voltage $V_{fb}$ the same as the input voltage $V_{ref}$. The output voltage $V_{out}$ is therefore constant.

As may be seen in FIG. 2, the voltage regulator circuit has a first stage 201, a second stage 202, and a third stage 203. The first stage 201 includes a tail current source transistor M12, and four transistors M9, M11, M4, and M10 that form a differential amplifier. Thus, the first stage 201 may be referred to as a differential amplifier 201. The first stage 201 also includes two load transistors M10, M4. The drain of the transistor M10 is tied to its gate, and the gates of the transistors M10, M4 are connected to each other. M12 is a current source for the amplifier 201 of the first stage 201.

M14 is a current source amplifier, with a transistor M13 acting as a diode load. Thus, the second stage 202 may be called "a common source amplifier with a diode load."

The voltage $V_{opo}$ is the output of the first amplifier stage 201. The output of the second stage 202 is the $V_{pbias}$. The voltage $V_{pbias}$ adjusts the current $I_{out}$ passed through the transistor M0 voltage. Thus, the output loading has a fixed voltage. If R1 is equal to R2, then the voltage $V_{fb}$ is equal to half of the output voltage $V_{out}$. When the circuit of FIG. 2 is stable, $V_{fb}$ should be equal to $V_{ref}$. Therefore, the output voltage $V_{out}$ should be equal to two times the voltage $V_{ref}$.

M10 and M4 function as a load for the amplifier formed by M9 and M11. The first stage 201 drives a relatively small load, because the transistor M14 is relatively small, and has a small parasitic capacitance. The first stage 201 has a high impedance output. Therefore, it cannot drive a high capacitance load. The second stage 202 has a low impedance output to drive the third stage 203. The second stage 202 also has low input capacitance. Thus, the first stage 201 can drive the second stage 202 easily. Also, the second stage 202 has a low impedance output. This enables it to drive a large capacitance load represented by the third stage 203. Also, the second stage 202 is necessary to enable current proportionality between $I_1$, $I_2$, and $I_{out}$.

The circuit shown in FIG. 2 may be called an adaptive bias circuit because the transistors M13 and M0 act as current mirrors. In other words, the currents $I_2$ and $I_{out}$ through the transistors M13 and M0, respectively, have a certain ratio. As an example, in FIG. 2, the $I_{out}/I_2$ current ratio is 1,000:8 (the downward arrows indicate the direction of the current flow in FIG. 2). Thus, in this case, if the output current is 1000 microamps, the current $I_2$ through the transistor M13 is 8 microamps. The $I_{out}/I_2$ ratio itself, in this case 1,000:8 generally depends on device characteristics and topology. The higher the number associated with the second stage 202, the higher the current consumption by the regulator 103. Therefore, a smaller ratio $I_{out}/I_2$ is desirable.

However, as the current $I_2$ associated with the second stage 202 gets smaller, the regulator 103 begins to lose stability. Thus, a ratio of approximately 1,000:8 is roughly optimal. In other words, the ratio is chosen such that the current $I_2$ through the second stage 202 is low enough, but the regulator circuit is still stable. By the same logic, with 1,000 microamps going through M0, two microamps ($I_1$) are going through the transistor M12 of the first stage 201. Generally, the ratios are determined by the sizes of the transistors involved. Thus, it is desirable to minimize the ratio, but the lower limit on the ratio is determined by closed loop stability considerations.

In the circuit of FIG. 2, the power consumption of the amplifier 201 is entirely dependent on the output current $I_{out}$. When the load is not consuming any power, the amplifier 201 also will not consume any power. Compared to the situation where there is a steady current flow through the first stage 201, this approach is more power-efficient.

Compared to a conventional two-stage voltage regulator, the addition of the second stage 202 improves the stability of the overall low voltage regulator 103. In a conventional two-stage regulator, the output voltage $V_{opo}$ of the first stage drives M0, and sees a very high impedance. M0, in a conventional circuit, is typically very large (to minimize its series resistance and headroom), and has a large parasitic capacitance. In terms of a pole-zero diagram, its pole is very low, due to the high impedance and the high capacitance. The dominant pole in the circuit of FIG. 2 is the pole P1.

The pole zero equations for the circuit of FIG. 2 are as follows:

$$p_1 = \frac{1}{R0\,C0}\alpha I_{out}$$

$$p_2 = \frac{1}{R2\,C_{fb}}$$

$$p_3 = \frac{1}{R4\,C_{opo}}\alpha I_{out}$$

$$p_4 = \frac{gm_{13}}{C_{pbias}}\alpha\sqrt{I_{out}} \quad \text{or} \quad \alpha I_{out} \quad \text{(weak inversion)}$$

$$Z_1 = \frac{1}{R_{ESR}\,C0}$$

P1, P3, P4 are tracking with $I_{out}$ (i.e., are all proportional to $I_{out}$). P2 and Z1 are fixed and close to each other. $R_{ESR}$ includes series resistance, such as bond wire, packaging, board trace, capacitor ESR, etc. $R_{ESR}$ is typically about 0.9 ohm.

In a conventional voltage regulator circuit, the first stage 201 directly drives the third stage 203 so there is no middle stage 202. The output impedance of M4 and M11 is inversely proportional to output current $I_{out}$. Thus, the first stage 201 needs to drive more current in order to reduce the output impedance of M4. Thus, a conventional regulator circuit requires driving more current through the first stage 201. This pushes the pole P3 further out from the output load pole P1. The disadvantage of such an approach is that it consumes more power.

In other words, without the second stage 202, making the regulator circuit more stable requires consuming more power. Adding the second stage 202 therefore helps, due to the small size of M14. The second stage 202 has a pole P4, however, the impedance of the second stage 202 is low, and it is able to drive a large load. Its impedance is therefore $$\frac{1}{gm13},$$

gm13 being the transconductance of M13. However, because of P3, the output impedance of the amplifier 201 is still high (the high impedance due to M11 and M4). M14, however, is a relatively small transistor, since it is not used to drive a load. Since M14 is small, its parasitic capacitance is small as well. Thus, the pole due to the $$\frac{1}{RC}$$

of the transistor M14 is very far out in a pole-zero diagram.

P3 is also far away from the output load pole P1. Thus, as noted above, P1 is the dominant pole. With P3 and P4 being far away from P1, this helps stability of the overall circuit. Since the output voltage $V_{out}$ is a constant, the output resistance is equal to $V_{out}/I_{out}$, i.e., the output resistance R0 is inversely proportional to the output current $I_{out}$. Thus, P1 is proportional to the output current $I_{out}$. P3 is inversely proportional to the output resistance of the transistor M4, and also inversely proportional to the parasitic capacitance. However, the output resistance is proportional to the current flowing through M4. Because of the current mirror effect, the current flow into M4 is in proportional to the current flow $I_{out}$ into the load. Thus, P3 is also proportional to the output current $I_{out}$.

The pole P4 is equal to gm13 divided by the capacitance $C_{pbias}$. The capacitance $C_{pbias}$ is approximately constant. However, gm13, the transconductance of M13, is proportional to the square root of the output current $I_{out}$. Under certain conditions, it may be directly proportional to the output current $I_{out}$. Thus, P1, P3, and P4 are all "tracking" with $I_{out}$, and are therefore all tracking with each other. Since P1 is not fixed, and depends on operating conditions, without the second stage 202, P3 is fixed as well. Thus, the impedance of the first stage 201, in the conventional regulator circuit, has to be designed for the worst case scenario—in other words, it has to consume a lot of current. On the other hand, with the adaptive biasing approach of FIG. 2, the current $I_1$ through the first stage 201 is always optimized. The pole P2 of the feedback stage is formed by the two resistors R1 and R2, and the capacitance of M11 (i.e., the feedback capacitance, which may be designated $C_{fb}$). $C_{fb}$ is also the input capacitance of M11. P2 is constant, and does not depend on output current $I_{out}$.

For low power design, the resistors R1 and R2 should be as large as possible. This way, the current flowing to R1 and R2 is small, saving power. However, making R1 and R2 very large results in a pole P2 that is very low. If P2 is close to P1, this affects stability of the circuit.

The solution to this is adding a zero to counteract P2. This zero is Z1, such that $$Z1 = \frac{1}{R_{ESR}C0}.$$

The zero Z0 comes from the load. C0 is a compensation capacitance, which is usually placed at the output of the regulator. However, the capacitance C0 is not ideal, and the usual has a certain resistance $R_{ESR}$. $R_{ESR}$ is known as effective series resistance, or may be referred to as a parasitic series resistance. Thus, the resistance $R_{ESR}$, in series with the capacitance C0, forms the zero Z1. If the zero Z1 is placed close to the pole P2, then they will cancel each other out. Thus, effectively, the circuit only has the poles P1, P3, and P4.

With P3 and P4 being far away from P1, the voltage regulator 103 will be stable, as the following example demonstrates.

For C0=1 μF and R0=2 Mohm to 24 Mohm ($V_{out}$=1.2V and $I_{out}$=0 to 50 mA), P1 varies from 0.08 Hz to 6.6 KHz.

P2~=450 KHz, Z1=320 KHz (for $R_{ESR}$=500 Mohm) (i.e., close to P2). P3 and P4 are 3 orders of magnitude higher than P1 (tracking).

The example above confirms that the circuit of FIG. 2 is stable.

Figure 3:
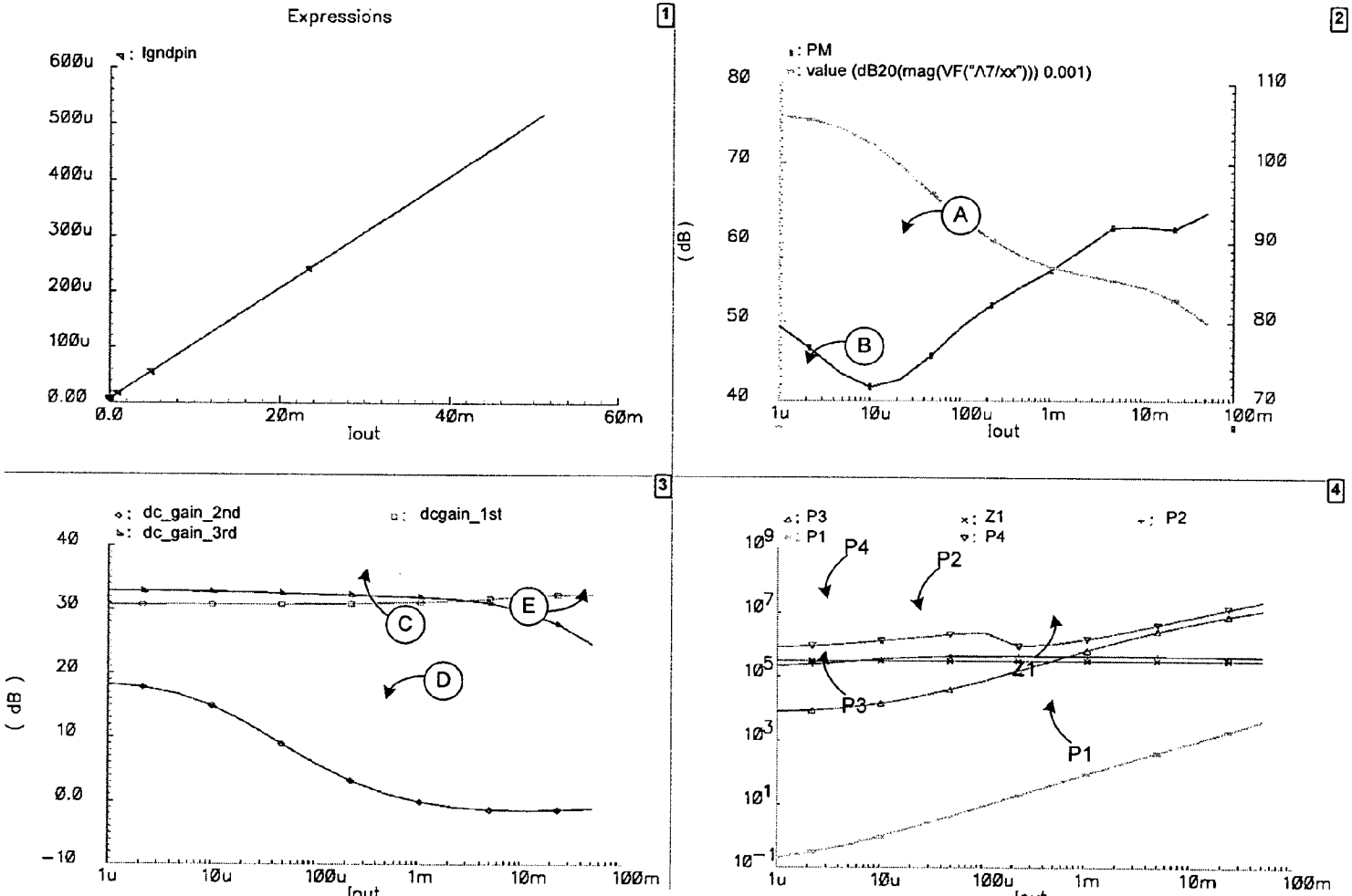
FIG. 3 illustrates characteristics of the circuit of FIG. 2 in graphical form.

FIG. 3 illustrates characteristics of the circuit of FIG. 2 in graphical form. In the upper right graph, the graph designated by A shows the open loop gain of the regulator 102. The graph designated by B shows the phase margin (PM) of the voltage regulator 103. In the bottom right curve, the positions of the poles P1, P2, P3, P4 and zero Z1 are shown, as a function of the output current $I_{out}$.

In the upper right graph, which shows the phase margin (PM), the curve designated by A shows that the phase margin is always greater than 60 degrees, which is good for stability. Curve B is the DC gain of the entire loop. Also, in FIG. 3, the lower left hand graph shows the DC gain of the first stage 201 of FIG. 2 (curve C), of the second stage 202 (curve D) and the third stage (curve E). The upper left hand graph shows the ground pin current $I_{gndpin}$ (i.e., the total current consumed by the regulator, roughly 1% of $I_{out}$) on the Y axis as a function of $I_{out}$.

Further with reference to FIG. 2, the circuit illustrated therein still has a number of problems. The first problem is the positive feedback between the first stage 201 and the second stage 202. The existence of the positive feedback has an undesirable effect on the phase margin. Generally, more power would be needed to fix this problem.

A better solution to this problem is the addition of another pole (called P5) in FIG. 4. The addition of the pole P5 is accomplished by adding the resistor R3 and the capacitor C1, as shown in FIG. 4. The pole P5 attenuates any AC signals that may be present due to the positive feedback effect between the second stage 202 and the first stage 201. The equations below show the analysis for the open loop gain of the circuit of FIG. 4.

$$\text{Gain} = -\frac{\frac{gm_{14}}{gm_{13}}\cdot gm_0R_0\cdot\frac{R2}{R1+R2}\cdot gm_{33}R4}{\left(1+\frac{s}{p_1}\right)\left(1+\frac{s}{p_2}\right)\left(1+\frac{s}{p_3}\right)\left(1+\frac{s}{p_4}\right)} + \frac{\frac{gm_{14}}{gm_{13}}\cdot\frac{gm_{12}}{2gm_4}}{\left(1+\frac{s}{p_3}\right)\left(1+\frac{s}{p_4}\right)}$$

$$= \frac{-(A_{DC}-1/2)\left[1-\frac{s}{(p_1+p_2)\cdot(A_{DC}-1/2)}\right]+\frac{s^2}{p_1p_2}}{\left(1+\frac{s}{p_1}\right)\left(1+\frac{s}{p_2}\right)\left(1+\frac{s}{p_3}\right)\left(1+\frac{s}{p_4}\right)}$$

$$\cong -\frac{\frac{gm_{14}}{gm_{13}}\cdot gm_0R0\cdot\frac{R2}{R1+R2}\cdot gm_{33}R4}{\left(1+\frac{s}{p_1}\right)\left(1+\frac{s}{p_2}\right)\left(1+\frac{s}{p_3}\right)}$$

where $$\frac{gm_{14}}{gm_4} = \frac{gm_{13}}{gm_{12}}$$

$$A_{DC} = \frac{gm_{14}}{gm_{13}}\cdot gm_0R_0\cdot\frac{R2}{R1+R2}\cdot gm_{33}R4$$

$$C_{fb} = \text{input capacitance of } M11$$

$$p_1 = \frac{1}{R0C0}$$

$$P_2 = \frac{1}{R2C_{fb}}$$

$$p_3 = \frac{1}{R4C_{opo}}$$

$$p_4 = \frac{gm_{13}}{C_{pbias}}$$

where $p_5 \ll A_{DC}\cdot p_1$ $C_{opo}$ in the equations above is the total capacitance of that node. $C_{opo}$ is the capacitance at the node $V_{opo}$, i.e., the parasitic capacitance seen at that node due to the transistors M14, M4, and M11.

FIG. 5 illustrates the effect the addition of the pole P5 on the phase margin. The right-hand-plane zero is at $(P_1+P_2)(A_{DC}-½)$, which hurts stability. As may be seen in FIG. 5, without the pole P5, the phase margin is only 50° (too low for stable operation), while with the pole P5, the phase margin is 80° (more than adequate for stability).

Another problem with the circuit of FIG. 2 is that when the output current $I_{out}$ is zero, the currents $I_1$, $I_2$ through the first and second stages 201, 202, are also zero. This is a problem because regulating the output voltage $V_{out}$ is not possible in that case. In other words, if the current $I_{out}$ is zero, the rest of the circuit starts floating.

The solution to this problem is the addition of "trickle" current to stages 201 and 202. This trickle current needs to be just large enough to make the rest of the circuit work when $I_{out}$=0, but can be small enough so as to consume very little power. The above solution is illustrated in a circuit of FIG. 6.

In FIG. 6, the addition of a resistor R4 provides current in the branch of the second stage 202, even when the transistor M13 is shut off. Typical current through R4 is on the order of 1 microamp. For the first stage 201, the trickle current is provided by the transistors M39 and M40. The transistor M40 may be referred to as a trickle current source, that provides a very small trickle current for low output current $I_{out}$ operation. This trickle current is also very small. The reason that the resistor R4 is used, instead of a current source with a transistor, is so that the pole P4 does not see a high impedance. Thus, R4 provides a "low impedance load", compared to a current source, so as to push P4 away when gm13 is too low. This avoids having the pole P4 become low, and causing stability problems. In other words, the presence of R4 pushes P4 away from P1.

However, the circuit of FIG. 6 still has a problem as follows: when VDD is close to $V_{out}$, M13 and M0 go into their triode regions. M13 no longer tracks to M0, and large current flows through M13 to take M0 into its triode region, even when $I_{out}$ is small.

In this situation, the transistor M0 no longer stays in its saturation region. Rather, it operates in a so called "triode region." When $V_{out}$ is equal to VDD, $V_{pbias}$ tries to pull low, so that there is low resistance. In the triode region of operation, the current of M13 no longer tracks the output current $I_{out}$. Another way of looking at this is that current mirrors M13, M0 only should operate in their saturation regions. Unless this problem is resolved, there will be a large leakage current to the ground.

In FIG. 6, when $V_{pbias}$ goes low, a high current $I_2$ wants to flow through M13. For low power designs, it is undesirable to have large currents flowing through M13 even when the output current $I_{out}$ is low. The solution, therefore, is to shut off M13 when M0 is operating in the triode region. In other words, the solution is to shut off M13 by forcing the voltage on the drain of M13 equal to $V_{out}$.

This is accomplished by the addition of a switch, which is illustrated in FIG. 7 as the transistor M31. An opamp 701 compares the output voltage $V_{out}$ with the reference voltage $V_{ref}$. Here, the voltage Vx serves as a proxy for the output voltage $V_{out}$. This is accomplished by having R1=R5, and R2=R6. The switch M31 forces Vx to be equal to the output voltage $V_{out}$. When Vx is close to VDD, the current through M31 is shut off. The current flow through R5 and R6 is very small, compared to the current flow through M13 in the absence of the amplifier 801, because the resistances R5 and R6 are very high compared to the source-drain resistance of M13. Also, the opamp 701 applies its output voltage to the switch M33 for the first branch for the same reason. This has a number of benefits:

For low power consumption, with a "high" resistor R4, the gm14×R4 gain is large, thus only a small current is required to make M0 go into deep triode region. Only 10 μA sustaining current (i.e., ground pin current $I_{gndpin}$) is needed for $I_{out}$=0 to 50 mA.

Also, a very low drop-out voltage is achieved: high gain at the second stage 202 due to high gm14*R4. $V_{pbias}$ is pulled down to a very low value. Drop-out voltage is only 14 mV when $I_{out}$=50 mA.

FIG. 8 illustrates how the low voltage regulator 103 of FIG. 7 can be converted into the high voltage low dropout regulator 102 of FIG. 1. As shown in FIG. 8, this is accomplished through the addition of an NMOS transistor M26, located between the transistors M14 and M31. The gate of the transistor M26 is driven by a suitable bias voltage $V_H$, typically approximately half of VDD. The bias voltage $V_H$ needs to be high enough to prevent a breakdown. It may be derived, for example, from a resistor divider network (not shown) in FIG. 8. The bias voltage $V_H$ should be higher than the threshold voltage $V_t$ of the NMOS transistor M26 plus the saturation voltage $V_{dsat}$ (sometimes referred to as headroom), of the NMOS transistor M14. It also has to be less than the breakdown voltage of the gate oxide of M26. For example, if M26 is a 3.3 volt breakdown device, then the bias voltage $V_H$ needs to be less than 3.3 volts. Nonetheless, it needs to be high enough to turn the transistor M26 on. Also, for the high voltage regulator 103, the substrate of every PMOS transistor is tied to their sources. Thus, the addition of the transistor M26 converts the low voltage regulator 103 of FIG. 7 into the high voltage regulator 102. Note also that the transistors M9 and M11 can have their sources and substrates tied together for protection from breakdown.

Drop-out voltage is the input to output differential voltage at which the circuit ceases to regulate against further reductions in input voltage VDD. This point occurs when the input voltage VDD approaches the output voltage $V_{out}$. For example, if the voltage regulator is meant to output 3.3 volts, and the input voltage VDD is 4 volts, drop-out voltage is not a problem. However, if the supply voltage VDD is, for example, 2.5 volts, the voltage regulator obviously cannot output 3.3 volts. Instead, it will output some voltage slightly less than the supply voltage VDD. The difference between the output voltage $V_{out}$ and the supply voltage VDD is called the drop-out voltage.

If the turn-on resistance of M0 is very low, then the drop-out voltage will be low as well. Since $V_{pbias}$ is allowed to go low in the circuit of FIGS. 7 and 8, the dropout voltage is also low, as low as 14 mV in the present invention. This is also illustrated in the graphs of FIG. 9. For comparison, FIG. 18 lists a number of regulators from other vendors, Texas Instruments, Maxim, and Phillips, showing much larger dropout voltages, e.g., 115 milivolts, 165 milivolts. Thus, the 14 millivolts drop-out of the circuit of FIG. 7 or 8 compares extremely favorably with conventional art.

Note also that the ground pin current (at no load) also compares very favorably (maximum 21 microamps, versus 30 or even 85 microamps for conventional art).

As may be seen in FIG. 9, when the output voltage of the main battery (labeled vmbat in FIG. 9) is higher than about 3.03 volts, the output voltage $V_{out}$ of the regulator 102 is a steady 3 volts. However, below 3.03 volts, the output voltage $V_{out}$ of the regulator is decreasing substantially linearly with the battery voltage vmbat. The upper curve in FIG. 9 shows the dropout voltage, which is approximately 14 millivolts when $V_{in}$#$V_{out}$. FIG. 10 shows the phase margin and open loop gain of the circuit of FIG. 7 as a function of frequency. In other words, FIG. 10 illustrates the stability of the circuit. As may be seen from the curve labeled G in FIG. 10, the phase margin is at least 60° in the relevant region of operation, evidencing a good stability of the regulator.

Power supply rejection ratio (PSRR), also known as ripple rejection, is a measure of the regulator's ability to prevent the regulated output voltage $V_{out}$ from fluctuating due to input voltage variations. Normally, the entire frequency spectrum is considered.

FIG. 11 shows a number of graphs for different manufacturing process parameters relating to power supply rejection ratio (PSRR), which is a measure of how resistant a regulator is to noise on the power supply. In this case, the PSRR is very good because the opamp 701 has a high gain.

Transient response, also known as line step response, is the maximum allowable output voltage variation for a load current step change. The transient response is a function of the output capacitor value C0, the equivalent series resistance $R_{ESR}$ of the output capacitor C0, the bypass capacitor ($C_B$) (not shown) that may be added to the output capacitor C0 to improve the load transient response, and the maximum load current.

FIG. 12 shows the line step response of the low voltage regulator 103 of FIG. 7. This figure illustrates what happens when VDD changes abruptly. In this case, when VDD, shown in the upper graph, changes from 3.1 volts to 3.6 volts in 10 microseconds, the output voltage $V_{out}$ of the regulator changes only by 1.9 millivolts. (See bottom curve in FIG. 12).

For the curves of FIG. 12, two 50 mA LDO regulators were arranged in parallel. Here temperature=25° C., $V_{out}$=2.4 V, VDD=3.1 to 3.6 in 10:sec, $I_{out}$=71 mA, C0=2:F, $R_{ESR}$=500 Mohm, and L(bondwire)=9 nH. $\Delta V_{out}$=1.9 mV, i.e., a very small ripple.

FIG. 13 illustrates line regulation, i.e., the change in the output voltage $V_{out}$ as a function of change in the supply voltage VDD (on the X axis). This graph illustrates that there is very little change in the output voltage $V_{out}$ for a relatively large change in the supply voltage VDD.

FIG. 14 illustrates the load regulation, i.e., the output voltage $V_{out}$ as a function of the output current $I_{out}$. This figure shows that for a relatively large change in $I_{out}$, the output voltage $V_{out}$ remains relatively steady.

FIG. 15 illustrates the turn-on time of the voltage regulator 102. This figure shows that the regulator 102 can turn off and on very fast. It also illustrates that there is very little change in the output voltage $V_{out}$ when the output current $I_{out}$ changes.

FIG. 16 is an illustration of the total power consumption as a function of current. The power consumption is a straight line, as expected, with a small offset. The slope of the straight line is approximately 1%, which is quite good for this type of regulator. The offset is due to the trickle current.

With reference now to the high voltage regulator 102 of FIG. 8, the high voltage regulator 102 cannot be powered down when the rest of the circuit is "asleep," therefore, opportunities for saving power in this circuit are limited. Additionally, low dropout characteristics are also highly desirable in the high voltage regulator 102. FIG. 17 illustrates the simulated performance of the high voltage regulator 102 with regard to the drop-out voltage.

FIG. 17 shows the change in the total current consumption of the regulator at maximum current as a function of the change in VDD. The current consumption is =10 mA (=1% of $I_{out}$). When VDD changes, it is desirable to hold the output voltage $V_{out}$ at 3.3 volts. If VDD drops below 3.3 volts, then the output voltage $V_{out}$ tracks to VDD, which is shown in the bottom graph. However, there is some drop-out voltage, which is illustrated in the middle graph. In other words, the middle graph shows the difference between the input voltage VDD and the output voltage $V_{out}$. The $I_{gndpin}$ is 5:a in the drop-out region. The upper graph shows total current consumption by the circuit (not including the output current $I_{out}$. The upper graph shows that the current consumption is very small. Particularly, below 3.3 volts, the current consumption is extremely small due to the operation of M31.

FIG. 18 shows a summary of performance of the circuit of FIG. 7 (the column labeled BRCM) relative to performance of voltage regulators from Texas Instruments, Philips and Maxim. Note that with regard to FIG. 18, three generic load drop-out regulators in parallel will result in a maximum output current of 150 milliamps. The output voltage $V_{out}$ accuracy is limited by the band gap of the semiconductors.

With reference now to FIG. 19, the circuit illustrated therein is used as a multiplexer to select different power sources. For example, in a cellular phone, the various power sources may be the main battery, the recharger, or the backup battery. In FIG. 19, two of such possible power sources are designated as VDD1 and VDD0. Thus, the circuit in FIG. 19 is used as a selector circuit, to select the power source among the various alternatives (in the case of a cellular phone, e.g., the charger, the main battery, and the backup battery).

In conventional circuits, CMOS switches are used. However, the control voltage needs to be very high. That way, there is no Vt drop between the gate and the source of the NMOS transistor. In other words, if nothing is done, the control voltage will be equal to the source voltage for NMOS. This presents a problem, because the output always has a Vt drop. In other words, to turn on an NMOS transistor, the gate voltage has to be higher than the source voltage by at least Vt. However, the gate voltage in a conventional circuit is equal to VDD. Thus, the source voltage will be equal to VDD−Vt. This is undesirable, because is it preferable to have a zero voltage drop across the power selector/multiplexer.

A charge pump may be used in a conventional circuit in order to pump up the gate voltage to a higher voltage. In this case, the gate voltage is at least Vt higher than VDD. Therefore, if the gate voltage is pumped up to a higher level, the Vt drop no longer presents a problem, and the output voltage is still therefore equal to VDD. However, such a circuit is more noisy, and consumes more power, because conventional charge pumps require a clock to pump up the voltage. On the other hand, the circuit of FIG. 19 does not require a clock. This is accomplished through the use of a native NMOS device. Native NMOS devices can be manufactured using standard CMOS processing. A native NMOS device has characteristics of having a slightly negative threshold voltage Vt. Thus, even though the gate voltage is the same as VDD, there is no Vt drop, because Vt for native NMOS devices is negative.

However, if an NMOS device is used, it cannot be turned off completely because the Vt is negative. This causes leakage. The solution to this problem is the addition of four PMOS transistors "on top" of the native NMOS devices. These four transistors are designated MP0, MP1, MP2 and MP3 in FIG. 19. The addition of the transistors MP0-MP3 protects the NMOS devices from leakage. Thus, the circuit illustrated in FIG. 19 has the advantage of outputting VDD when it is ON, and no leakage current when it is OFF.

For example, consider the case of switching the input supply from VDD1 to VDD0. In this case, assume that VDD1 is 3 volts. In the worse case scenario, VDD0 is inadequate. Thus, in the worst case, if VDD0 is completely discharged, and is at ground potential, the current will leak into VDD0. In other words, there may be leakage from VDD1 through MN1 to VDD0, which occurs because VDD0 is much lower than the output voltage. This causes a reverse current to flow into VDD0. This is undesirable, since a zero reverse current is preferable, to avoid discharging the battery unnecessarily. The addition of MP3 and MP2 in series with MN1 prevents the reverse current from flowing into VDD0. The voltage at V1, in steady state, is equal to |Vt| of the native device, which is around 0.1 volts. If V1 is greater than the threshold voltage |Vt|, then MN1 is shut off. Thus, V1 will be balanced at about 0.1 volts. Therefore, MP3 will be turned off as well because $V_{set}-V1>Vt_{MP3}$. MP2 will also be turned off. Thus, no current flows back to VDD0.

Note that in this case, using a single PMOS transistor in the path, as opposed to two transistors (e.g., both MP2 and MP3) will not work as well, because another leakage path exists. This leakage path goes through the substrate. The substrate in PMOS transistors is N-well. The source and drains are doped P+. If the substrate is lower in potential than the source-drain voltage, then the PN diode, formed by the junctions between the source and the substrate and the drain in the substrate, will be turned on. This, therefore, represents another leakage path. If one of the transistors, for example, MP2 is removed from the circuit, then V2 will "merge" into V1 and since V1 is approximately 0.1 volts, and V2 is connected to VDD0, the diode will just barely turn on (the 0.1 volt forward biasing). This causes a leakage. A similar analysis applies to removal of MP3, rather than MP2. In this case, if V1 is lower than VDD, then there is a leakage current from the drain to the substrate. Thus, both transistors MP2 and MP3 are necessary to prevent leakage current through the substrate.

CONCLUSION

While various embodiments of the present invention have been described above, it should be understood that they have been presented by way of example, and not limitation. It will be apparent to persons skilled in the relevant art that various changes in form and detail can be made therein without departing from the spirit and scope of the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Also, the order of method steps may be rearranged. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A voltage regulator circuit, comprising:

a high voltage linear regulator configured to provide an intermediate voltage based upon an input voltage; and a plurality of parallel low voltage regulators coupled to the high voltage linear regulator, each of the plurality of parallel low voltage regulators being configured to provide a corresponding regulated output voltage based upon the intermediate voltage, wherein at least one of the plurality of parallel low voltage regulators comprises:

a plurality of stages, each of the stages being configured to include a corresponding current that flows through its respective stage, the corresponding current for each of the stages being proportional to each other, wherein the at least one of the plurality of parallel low voltage regulators is configured to adjust the corresponding current for each of the stages to cause the corresponding regulated output voltage to be proportional to a reference voltage.

2. The voltage regulator circuit of claim 1, wherein each of the plurality of parallel low voltage regulators is configured to receive the intermediate voltage.

3. The voltage regulator circuit of claim 1, wherein the high voltage linear regulator is a low dropout voltage regulator.

4. The voltage regulator circuit of claim 1, wherein at the least one of the plurality of parallel low voltage regulators has a dropout voltage of not more than approximately 14 millivolts for an output current from 0 to 50 mA.

5. The voltage regulator circuit of claim 1, wherein the plurality of stages comprise:

a first stage configured to receive the reference voltage and to include a first current flowing through the first stage;

a second stage, coupled to the first stage, configured to include a second current flowing through the second stage; and a third stage, coupled to the second stage, configured to output the corresponding regulated output voltage and include a third current flowing through the third stage, wherein the first, second and third currents are proportional to each other throughout a range of operation of the voltage regulator between substantially zero output current and a maximum output current.

6. The voltage regulator circuit of claim 5, wherein the third stage comprises:

a pass transistor, wherein the second stage comprises:

a first mirror transistor and an input transistor in series with the first mirror transistor, and wherein a gate of the first mirror transistor is driven by a substantially similar voltage as a gate of the pass transistor.

7. The voltage regulator circuit of claim 6, wherein the first stage comprises:

a second mirror transistor, wherein a gate of the second mirror transistor is driven by a substantially voltage as the gate of the pass transistor.

8. The voltage regulator circuit of claim 7, further comprising:

a low pass filter coupled between the gate of the second mirror transistor and the gate of the first mirror transistor.

9. The voltage regulator circuit of claim 8, wherein the low pass filter comprises:

an RC network.

10. The voltage regulator circuit of claim 7, wherein the first stage further comprises:

a first trickle current source in parallel with a current source, wherein the current source is parallel with the first mirror transistor.

11. The voltage regulator circuit of claim 10, further comprising:

a second trickle current source supplying a trickle current to the second stage.

12. The voltage regulator of claim 11, further comprising:

a first shut off transistor in series with the first mirror transistor and the input transistor of the second stage, wherein a gate of the first shut off transistor is configured to receive an output of an opamp, and wherein the opamp is configured to receive the reference voltage at a first input and a voltage from a resistor divider at a second input.

13. The voltage regulator circuit of claim 12, further comprising:

a second shut off transistor in series with the second mirror transistor and the input transistor of the first stage, wherein a gate of the second shut off transistor is configured to receive an output of an opamp.

14. The voltage regulator circuit of claim 12, further comprising:

an NMOS transistor coupled between the first shut off transistor and the input transistor.

15. The voltage regulator circuit of claim 5, further comprising:

a feedback stage having a resistor divider coupled between the third stage and the first stage, wherein a feedback voltage from the resistor divider controls an amplification of the first stage.

16. The voltage regulator circuit of claim 1, wherein the intermediate voltage is substantially less than or equal to a breakdown voltage of the plurality of parallel low voltage regulators and the input voltage is substantially greater than or equal to the breakdown voltage.

17. The voltage regulator circuit of claim 1, further comprising:

a multiplexer configured to provide the input voltage by selecting a respective output voltage provided by one of a plurality of power sources.

18. The voltage regulator circuit of claim 17, wherein the multiplexer comprises:

a plurality of native NMOS devices, each native NMOS device is coupled to a corresponding power source from the plurality of power sources.

19. The voltage regulator circuit of claim 18, wherein the multiplexer comprises:

a first PMOS device coupled to the corresponding power source from the plurality of power sources; and a second PMOS device coupled to the first PMOS device and a corresponding native NMOS device from the plurality of native NMOS devices.

20. The voltage regulator circuit of claim 1, wherein at least one of the plurality of parallel low voltage regulators includes a low dropout regulator.

21. A voltage regulator circuit, comprising:

a multiplexer configured to select a respective power source from a plurality of power sources, wherein the multiplexer includes a plurality of native NMOS devices, each native NMOS device being coupled to a corresponding power source from the plurality of power sources;

a high voltage linear regulator configured to receive the power source and to provide an intermediate voltage; and a plurality of parallel low voltage regulators coupled to the high voltage linear regulator configured to provide a regulated output voltage based upon the intermediate voltage.

22. The voltage regulator circuit of claim 21, wherein the multiplexer comprises:

a first PMOS device coupled to the corresponding power source from the plurality of power sources; and a second PMOS device coupled to the first PMOS device and a corresponding native NMOS device from the plurality of native NMOS devices.

23. The voltage regulator circuit of claim 21, wherein each of the plurality of parallel low voltage regulators is configured to receive the intermediate voltage.

24. The voltage regulator circuit of claim 21, wherein the plurality of power sources is received from at least one of: a main battery, a recharger, and a backup battery.

25. The voltage regulator circuit of claim 21, wherein at least one of the plurality of parallel low voltage regulators is a low dropout voltage regulator.

26. The voltage regulator circuit of claim 21, wherein at least one of the plurality of parallel low voltage regulators has a dropout voltage of not more than approximately 14 millivolts for an output current from 0 to 50 mA.

27. The voltage regulator circuit of claim 21, wherein at least one of the plurality of parallel low voltage regulators comprises:

a first stage configured to receive a reference voltage and to include a first current flowing through the first stage;

a second stage, coupled to the first stage, configured to include a second current flowing through the second stage; and a third stage, coupled to the second stage, configured to output an output voltage and include a third current flowing through the third stage, wherein the first, second and third currents are proportional to each other throughout a range of operation of the voltage regulator between substantially zero output current and a maximum output current.

* * * * *